US008732078B1

(12) United States Patent
Billman et al.

(10) Patent No.: US 8,732,078 B1
(45) Date of Patent: May 20, 2014

(54) PROVIDING A PAYMENT

(75) Inventors: Bradly Jay Billman, San Antonio, TX (US); Brian Francisco Shipley, San Antonio, TX (US); Benjamin Hunter Stotts, Spring Branch, TX (US)

(73) Assignee: United Services Automobile Association (USAA), San Antonio, TX (US)

( * ) Notice: Subject to any disclaimer, the term of this patent is extended or adjusted under 35 U.S.C. 154(b) by 877 days.

(21) Appl. No.: 11/877,942

(22) Filed: Oct. 24, 2007

(51) Int. Cl.
*G06Q 40/00* (2012.01)

(52) U.S. Cl.
USPC ..... 705/40

(58) Field of Classification Search
USPC ..... 705/40
See application file for complete search history.

(56) References Cited

U.S. PATENT DOCUMENTS

| | | | | |
|---|---|---|---|---|
| 6,292,789 | B1 | 9/2001 | Schutzer | |
| 6,745,179 | B2 | 6/2004 | Laronge et al. | |
| 6,847,953 | B2 | 1/2005 | Kuo | |
| 6,980,970 | B2 | 12/2005 | Krueger et al. | |
| 7,069,250 | B2 | 6/2006 | Meadow et al. | |
| 7,162,436 | B1 | 1/2007 | Eckel, Jr. | |
| 7,184,980 | B2 | 2/2007 | Allen-Rouman et al. | |
| 7,203,315 | B1 | 4/2007 | Livesay | |
| 7,210,620 | B2 | 5/2007 | Jones | |
| 7,222,098 | B2 | 5/2007 | Silverbrook et al. | |
| 7,225,156 | B2 | 5/2007 | Fisher et al. | |
| 7,373,329 | B2 | 5/2008 | Gallagher et al. | |
| 2002/0046189 | A1 | 4/2002 | Morita et al. | |
| 2004/0236681 | A1 | 11/2004 | Modigliani et al. | |
| 2005/0027654 | A1 * | 2/2005 | Adrian | 705/40 |
| 2006/0195398 | A1 | 8/2006 | Dheer et al. | |
| 2006/0212393 | A1 | 9/2006 | Brown | |
| 2008/0015982 | A1 * | 1/2008 | Sokolic et al. | 705/39 |
| 2008/0082434 | A1 | 4/2008 | Qian et al. | |
| 2008/0103984 | A1 | 5/2008 | Choe et al. | |
| 2008/0103985 | A1 * | 5/2008 | Huang et al. | 705/76 |

OTHER PUBLICATIONS

Welcome—PayPal, 1999-2007, p. 1-p. 2, PayPal, https://www.paypal.com.

Wells Fargo Small Business—Accept Credit Cards, Accelerate Your Business by Accepting Credit Cards, 1999-2007, p. 1-p. 2, Wells Fargo, https://www.wellsfargo.com/biz/email_form/merchant.

ClickandBuy ePayment, 2000-2007, p. 1-p. 2, ClickandBuy, http://clickandbuy.com/US/en/wasist/wasist.html.

iKobo—Money Transfer Services—Send Money Online, iKobo Money Transfer, 2001-2007, p. 1-p. 2, iKobo, Inc., http://www.ikobo.com.

Payment Gateway to Accept Online Payments, Authorize.Net, 2005, 2007, p. 1, Authorize.Net, http://www.authorize.net/.

Google Checkout, Find it with Google. Buy it with Google Checkout, 2007, p. 1, Google, https://www.google.com/accounts/ServiceLogin?service=sierra &continue=https%3A%2F%2Fcheckoutgoogle.com%2f%3Fg....

Obopay—Money Transfer by Cell Phone or Web, It's money on your phone, 2007, p. 1-p. 2, Obopay, Inc., https://www.obopay.com/consumer/.

BidPay—Auction Payment Service—BidPay.com, A Better Way to Pay, 2007, p. 1-p. 2, BidPay.com, http://www.bidpay.com.

* cited by examiner

*Primary Examiner* — Lindsay M. Maguire
(74) *Attorney, Agent, or Firm* — Perkins Coie LLP

(57) ABSTRACT

Systems and methods to provide a payment include techniques to receive, from a customer, an electronic request for the payment, associate the request with an account designated by the customer, electronically send the request for the payment to a payer designated by the customer, receive the payment from the payer, and deposit the payment into the account designated by the customer.

21 Claims, 20 Drawing Sheets

PROVIDING A PAYMENT

CROSS REFERENCE TO RELATED APPLICATIONS

The present application is related to (1) U.S. Utility application Ser. No. 11/877,824, filed on Oct. 24, 2007, now abandoned, and (2) U.S. Utility application Ser. No. 11/877,907, filed on Oct. 24, 2007, now abandoned, the disclosures of which are incorporated herein by reference.

FIELD OF THE DISCLOSURE

Various embodiments of the disclosure pertain to providing a payment, such as, for example, from a payer to a payee, in order to avoid making the payment in cash and in order to promote depositing the payment into an account at a financial institution.

BACKGROUND

Typically, payments for services such as, for example, delivering papers, baby sitting, lawn mowing, snow shoveling, pet sitting, and a variety of other services, are often made in cash to an individual. However, many times the payment is not deposited into a bank account or other financial account. In some situations, it may be undesirable for the payment to be received in cash, as such payments may be easily spent, lost, or stolen without any portion being saved.

Accordingly, it is desirable to provide a payment in an improved manner which avoids the above-mentioned problems.

SUMMARY

Various embodiments of the present disclosure are directed to systems and methods to provide a payment. The systems and methods provide techniques to receive, from a customer, an electronic request for the payment, associate the request with an account designated by the customer, electronically send the request for the payment to a payer designated by the customer, receive the payment from the payer, and deposit the payment into the account designated by the customer.

BRIEF DESCRIPTION OF THE DRAWINGS

FIG. 4*l* is a screenshot illustrating an embodiment of a Payment Received Message webpage used to provide a payment.

DETAILED DESCRIPTION

Figure 1A:
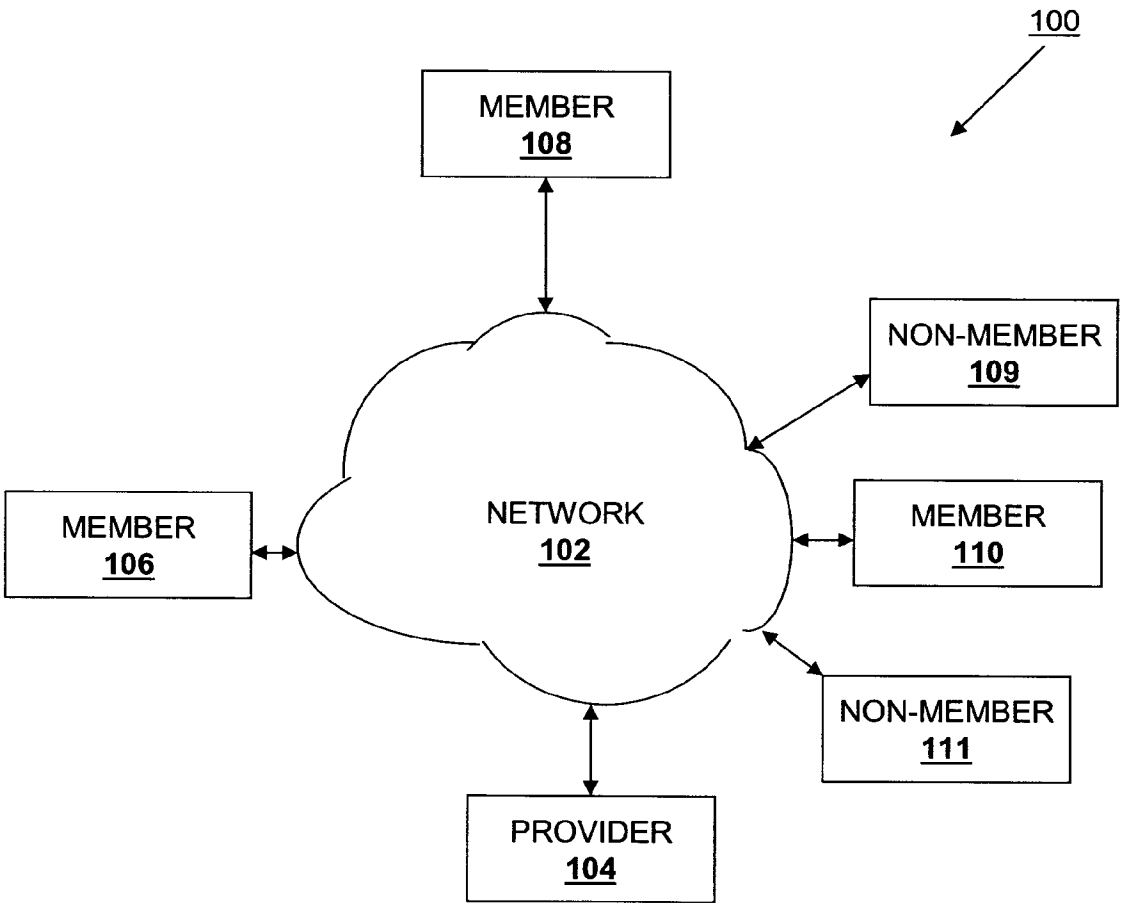
FIG. 1*a* is a schematic view illustrating an embodiment of a system to provide a payment.

Referring now to FIG. 1*a*, in one embodiment, a system 100 to provide a payment is illustrated. The system 100 includes a network 102 such as, for example, a Transport Control Protocol/Internet Protocol (TCP/IP) network (e.g., the Internet or an intranet). A provider 104 is operably coupled to the network 102. A plurality of members 106, 108 and 110 are also operably coupled to the network 102 in order to allow communication between the members 106, 108 and 110 and the provider 104. A plurality of non-members 109 and 111 are also operably coupled to the network 102 in order to allow communication between the non-members 109 and 111, the members 106, 108, and 110, and the provider 104. In an embodiment, the provider includes a banking or savings organization which provides savings accounts, checking accounts, investment accounts, retirement accounts, and/or a variety of other financial accounts. In an embodiment, the provider 104 includes a membership organization which provides a plurality of services for its members, such as, for example, banking, insurance, financial services, loans, and/or a variety of other services known in the art, wherein the members include members 106, 108 and 110. In an embodiment, the non-members 109 and 111 are not members of the provider 104 membership organization, but conduct business transactions with the members 106, 108, and/or 110, wherein the business transactions require a payment transfer between the members 106, 108, and 110 and the non-members 109 and 111. In an embodiment, the provider 104 is a third party with respect to the members 106, 108, and 110 and the non-members 109 and 111 and the provider 104 may facilitate a payment between the multiple members 106, 108, and 110, between a member 106, 108, or 110 and a non-member 109 or 111, and/or between the multiple non-members 109 and 111.

Each of the provider 104, the members 106, 108 and 110, and the non-members 109 and 111 includes a respective network interface for communicating with the network 102 (e.g., outputting information to, and receiving information from, the network 102), such as by transferring information (e.g., instructions, data, signals) between such members 106, 108, and 110, non-members 109 and 111, and the network 102. Accordingly, through the network 102, the provider 104, the members 106, 108, and 110, and the non-members 109 and 111 communicate with one another.

For clarity, FIG. 1*a* depicts only one provider 104. However, the system 100 may include a plurality of providers. Likewise, for clarity, FIG. 1*a* depicts only three members 106, 108 and 110. However, the system 100 may include any plurality of members. Similarly, for clarity, FIG. 1*a* depicts only two non-members 109, and 111. However, the system 100 may include any plurality of non-members.

Each of the provider 104, the members 106, 108 and 110, and the non-members 109 and 111 includes a respective information handling system (IHS), a subsystem, or a part of a subsystem for executing processes and performing operations (e.g., processing or communicating information) in response thereto, as discussed further below. Each such IHS is formed by various electronic circuitry components. Moreover, as illustrated in FIG. 1*a*, all such IHSs are coupled to each other through the network 102. Accordingly, the provider 104, the members 106, 108 and 110, and the non-members 109 and 111 operate within the network 102.

An IHS is an electronic device capable of processing, executing or otherwise handling information. Examples of an IHS include a server computer, a personal computer (e.g., a desktop computer or a portable computer such as, for example, a laptop computer), or a handheld computer. Examples of an IHS also include a router, a switch and other devices coupled to a network (e.g., the network 102).

Figure 1B:
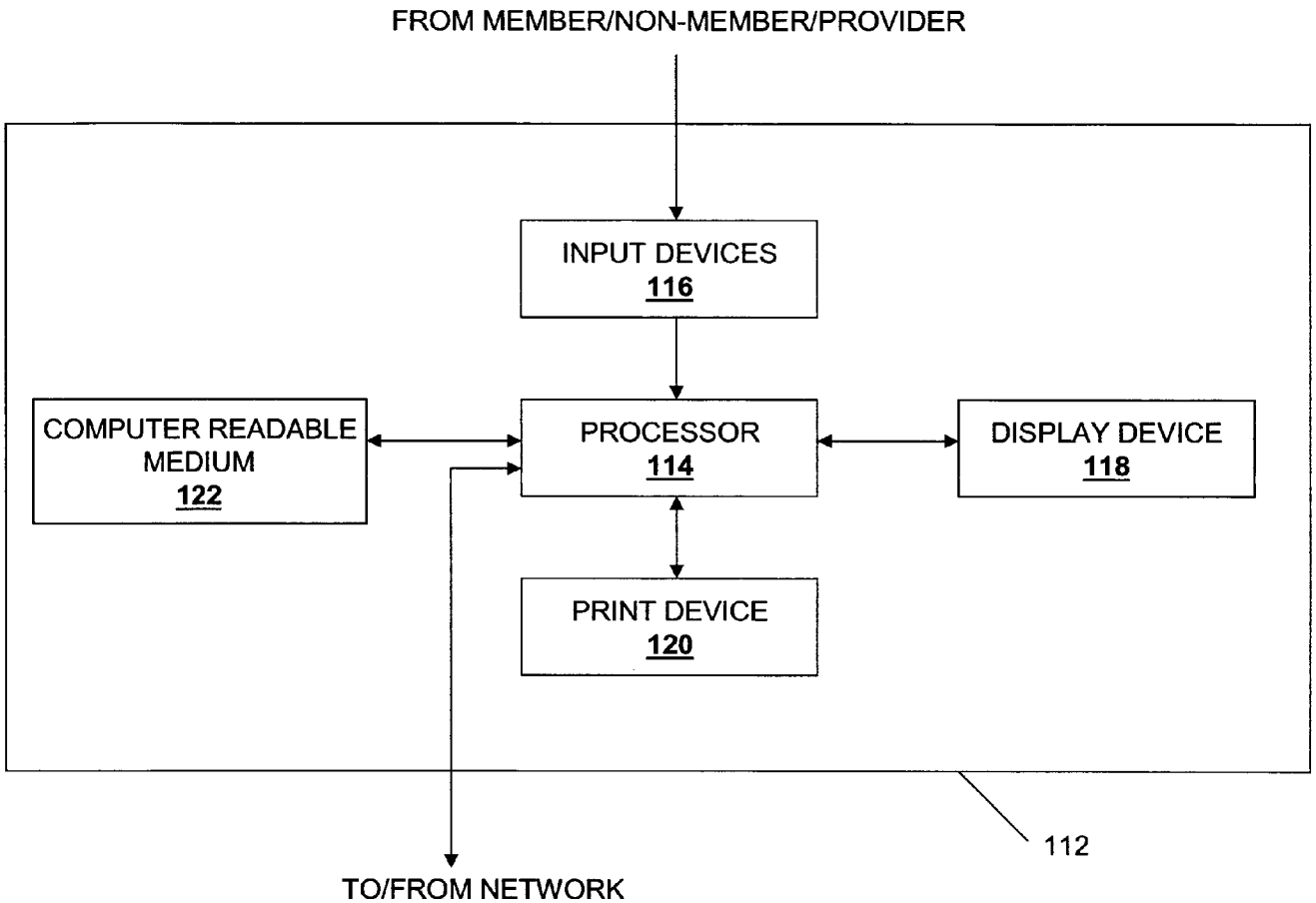
FIG. 1*b* is a schematic view illustrating an embodiment of an information handling system used with the system to provide a payment of FIG. 1*a*.

Referring now to FIG. 1*b*, an IHS 112 which is representative of one of the IHSs described above, is illustrated. The IHS 112 may include any or all of the following: (a) a processor 114 for executing and otherwise processing instructions, (b) a plurality of input devices 116, which are operably coupled to the processor 114, for inputting information, (c) a display device 118 (e.g., a conventional electronic cathode ray tube (CRT) device or a conventional liquid crystal display (LCD)), which is operably coupled to the processor 114, for displaying information, (d) a print device 120 (e.g. a conventional electronic printer or plotter), which is operably coupled to the processor 114, for printing visual images (e.g., textual or graphic information on paper), scanning visual images, and/or faxing visual images, (e) a computer-readable medium 122, which is operably coupled to the processor 114, for storing information, as discussed further below, and (f) various other electronic circuitry for performing other operations of the IHS 112 known in the art.

For example, the IHS 112 may include (a) a network interface (e.g., circuitry) for communicating between the processor 114 and the network 102 and (b) a memory device (e.g., a random access memory (RAM) device or a read-only memory (ROM) device for storing information (e.g., instructions executed by processor 114 and data operated upon by processor 114 in response to such instructions)). Accordingly, the processor 114 is operably coupled to the network 102, the input devices 116, the display device 118, the print device 120, and the computer-readable medium 122, as illustrated in FIG. 1*b*.

For example, in response to signals from the processor 114, the display device 118 displays visual images. Information may be input to the processor 114 from the input devices 116, and the processor 114 may receive such information from the input devices 116. Also, in response to signals from the processor 114, the print device 120 may print visual images on paper, scan visual images, and/or fax visual images.

The input devices 116 include a variety of input devices known in the art such as, for example, a conventional electronic keyboard and a pointing device such as, for example, a conventional electronic mouse, trackball, or light pen. The keyboard may be operated to input alphanumeric text information to the processor 114, and the processor 114 may receive such alphanumeric text information from the keyboard. The pointing device may be operated to input cursor-control information to the processor 114, and the processor 114 may receive such cursor-control information from the pointing device.

The computer-readable medium 122 and the processor 114 are structurally and functionally interrelated with one another as described below in further detail. Each IHS of the illustrative embodiment is structurally and functionally interrelated with a respective computer-readable medium, similar to the manner in which the processor 114 is structurally and functionally interrelated with the computer-readable medium 122. In that regard, the computer-readable medium 122 is a representative one of such computer-readable media including, for example, but not limited to, a hard disk drive.

The computer-readable medium 122 stores (e.g., encodes, records, or embodies) functional descriptive material (e.g., including but not limited to software (also referred to as computer programs or applications) or data structures). Such functional descriptive material imparts functionality when encoded on the computer-readable medium 122. Also, such functional descriptive material is structurally and functionally interrelated to the computer-readable medium 122.

With such functional descriptive material, data structures define structural and functional interrelationships between such data structures and the computer-readable medium 122 (and other aspects of the system 100). Such interrelationships permit the data structures' functionality to be realized. Also, within such functional descriptive material, computer programs define structural and functional interrelationships between such computer programs and the computer-readable medium 122 (and other aspects of the system 100). Such interrelationships permit the computer programs' functionality to be realized.

For example, the processor 114 reads (e.g., accesses or copies) such functional descriptive material from the computer-readable medium 122 onto the memory device of the IHS 112, and the IHS 112 (more particularly, the processor 114) performs its operations, as described elsewhere herein, in response to such material which is stored in the memory device of the IHS 112. More particularly, the processor 114 performs the operation of processing a computer application (that is stored, encoded, recorded, or embodied on a computer-readable medium) for causing the processor 114 to perform additional operations, as described elsewhere herein. Accordingly, such functional descriptive material exhibits a functional interrelationship with the way in which processor 114 executes its processes and performs its operations.

Further, the computer-readable medium 122 is an apparatus from which the computer application is accessible by the processor 114, and the computer application is processable by the processor 114 for causing the processor 114 to perform such additional operations. In addition to reading such functional descriptive material from the computer-readable medium 122, the processor 114 is capable of reading such functional descriptive material from (or through) the network 102 which is also a computer-readable medium (or apparatus). Moreover, the memory device of the IHS 112 is itself a computer-readable medium (or apparatus).

Figure 1C:
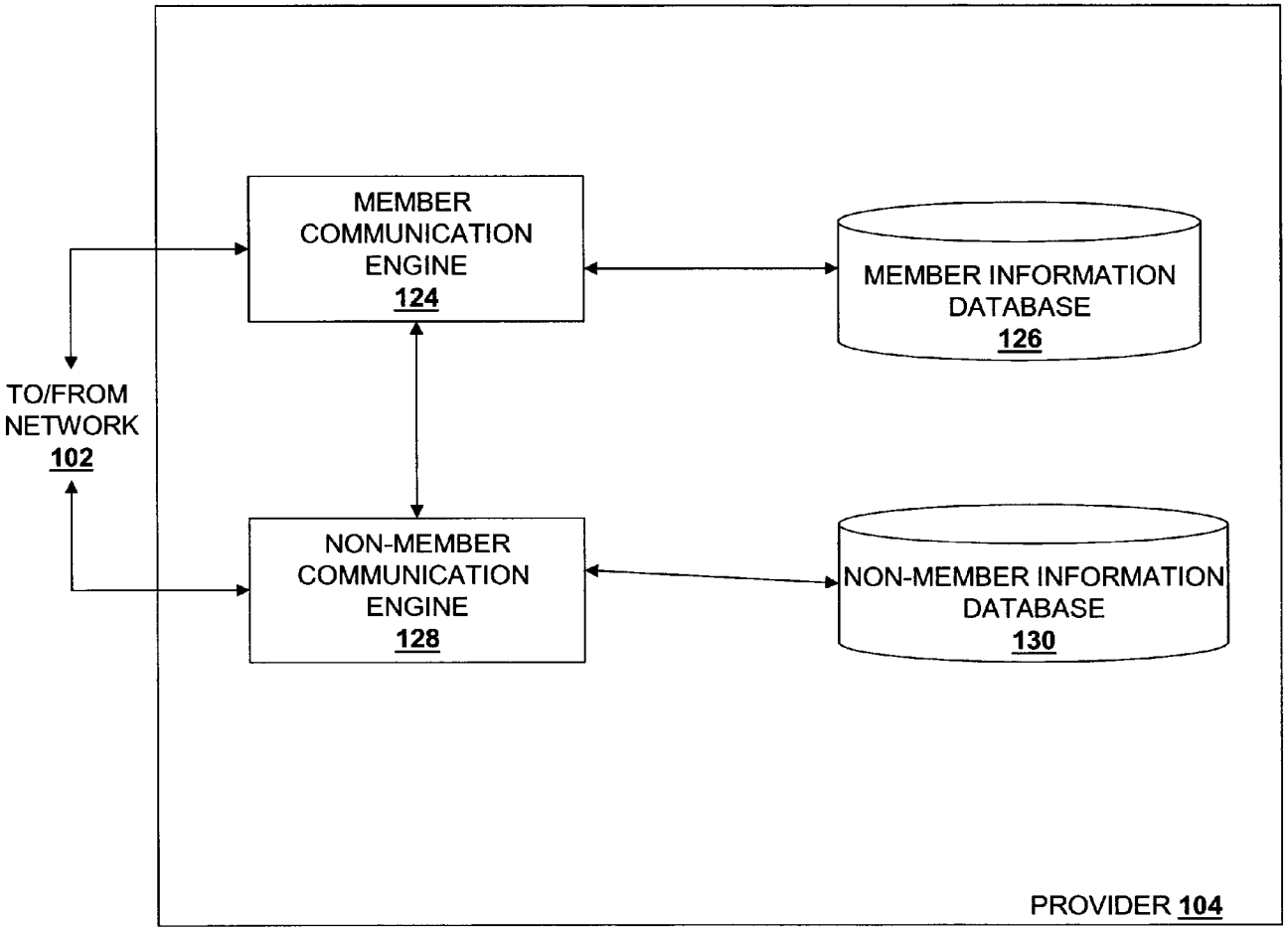
FIG. 1*c* is a schematic view illustrating an embodiment of a provider used in the system to provide a payment of FIG. 1*a*.
Figure 2A:
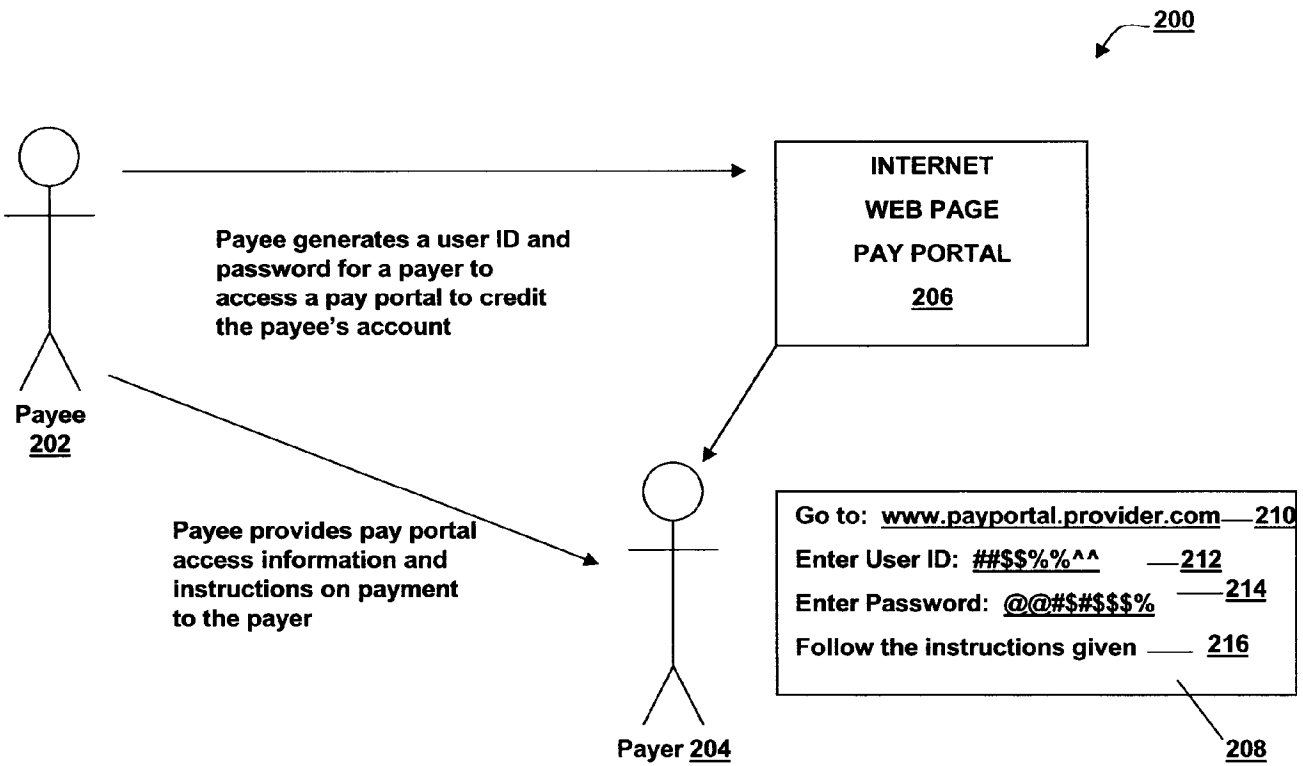
FIG. 2*a* is a schematic view illustrating an embodiment of a payee's process flow to provide a payment.
Figure 2B:
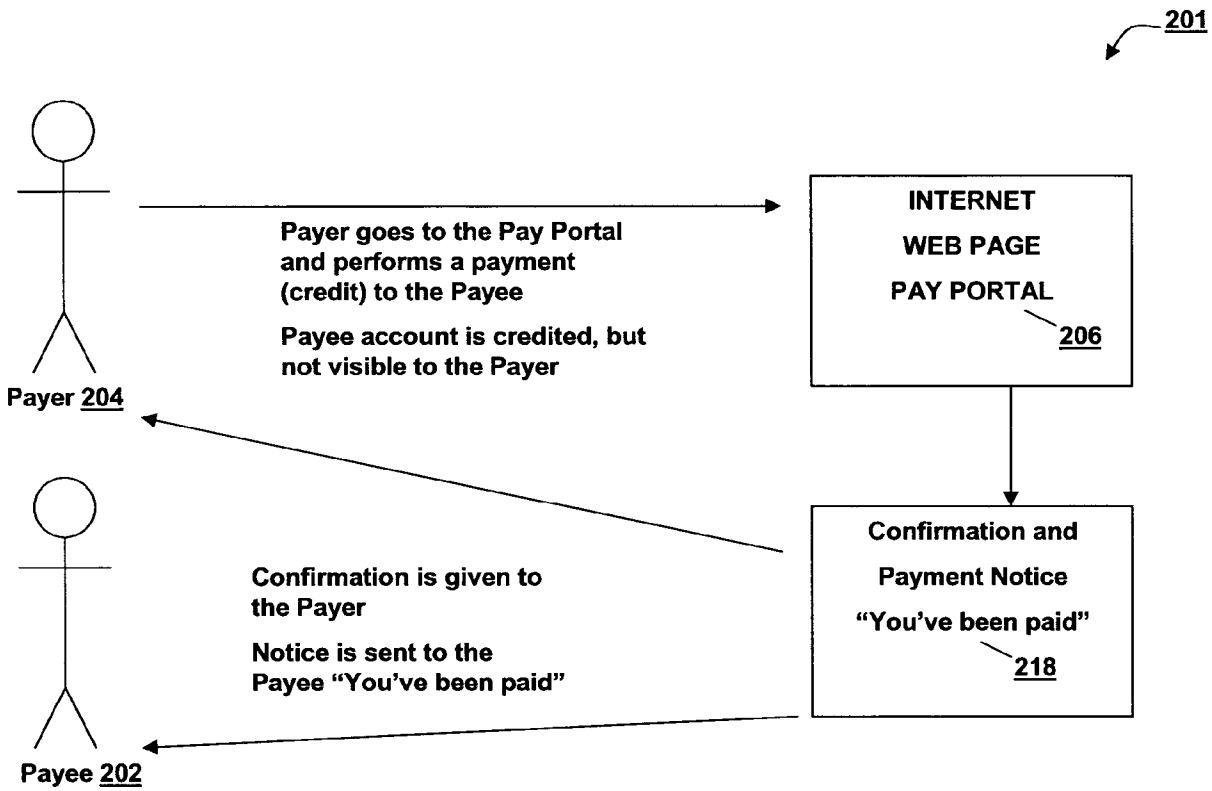
FIG. 2*b* is a schematic view illustrating an embodiment of a payer's process flow to provide a payment.
Figure 3A:
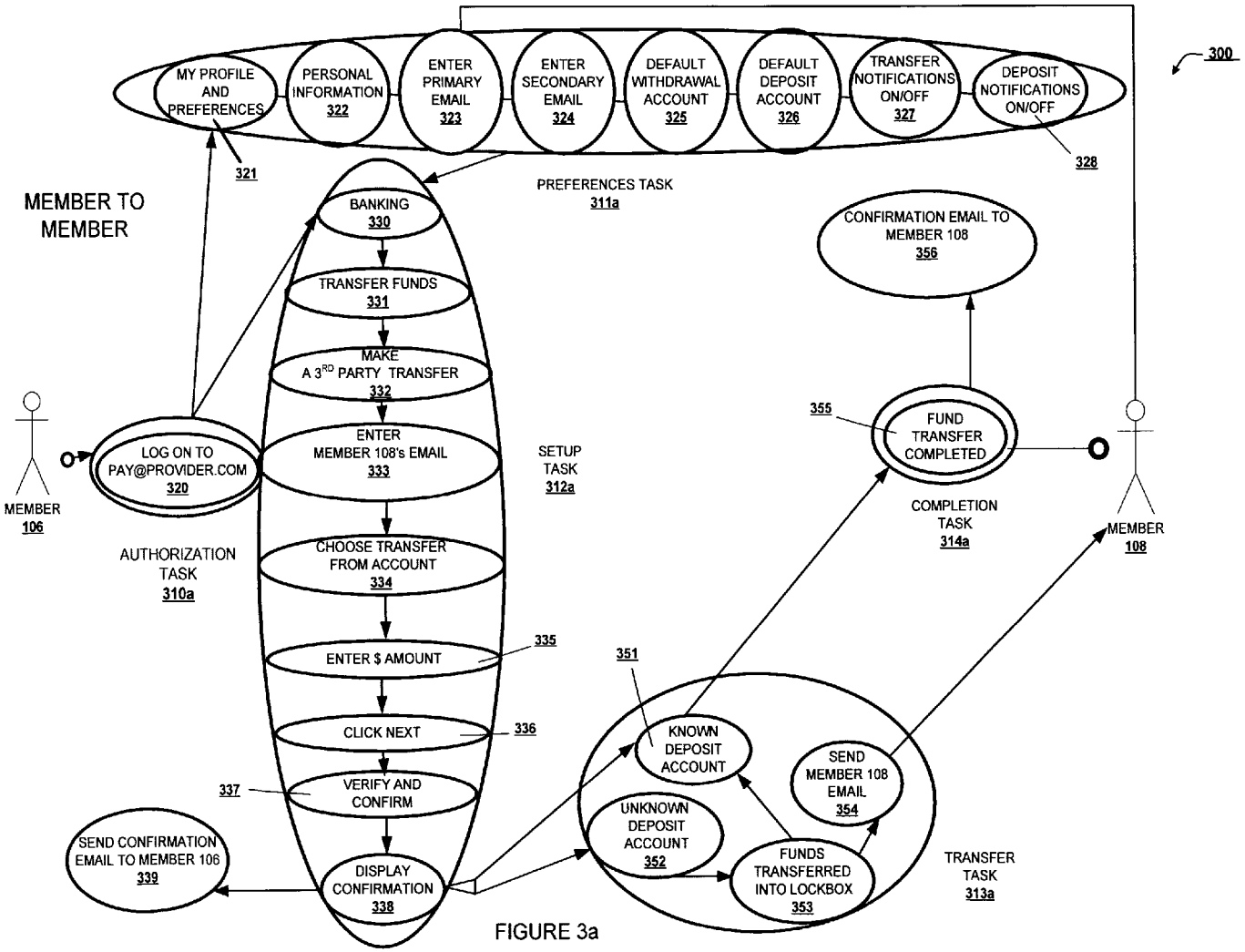
FIG. 3*a* is a flow chart illustrating an embodiment of a method to provide a payment from a member of a membership organization to another member of the membership organization.
Figure 3B:
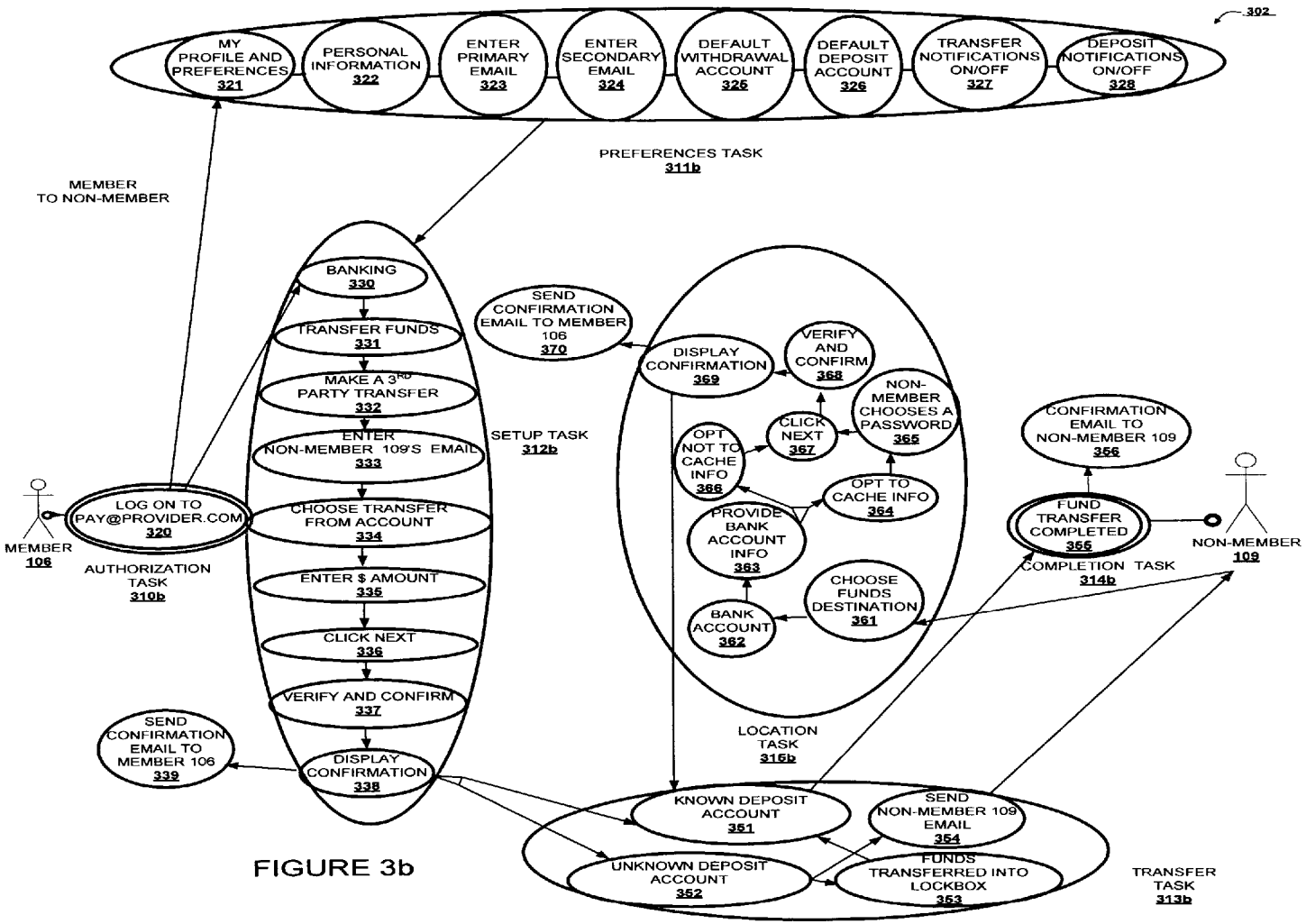
FIG. 3*b* is a flow chart illustrating an embodiment of a method to provide a payment from a member of a membership organization to a non-member of the membership organization.
Figure 3C:
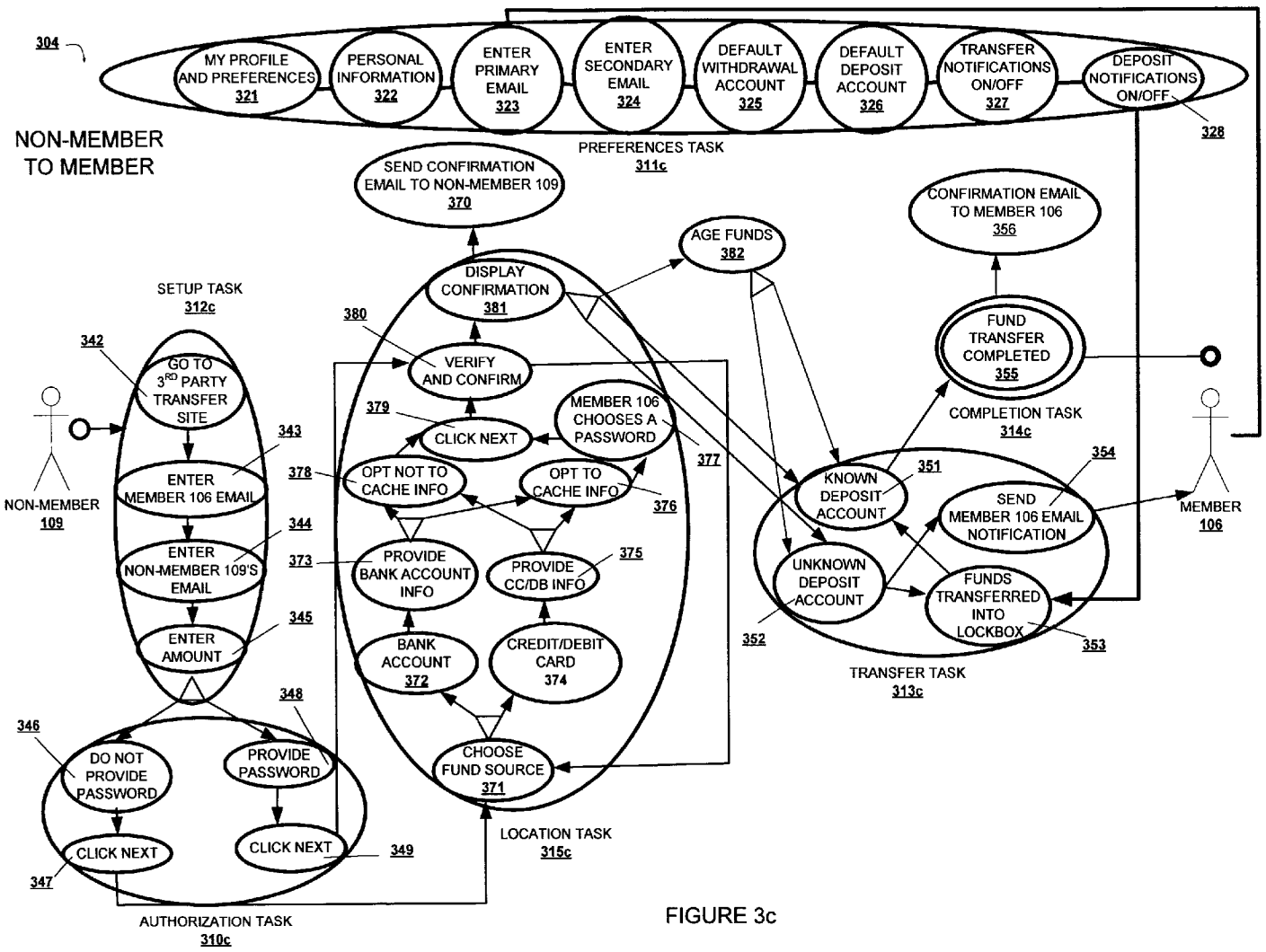
FIG. 3*c* is a flow chart illustrating an embodiment of a method to provide a payment from a non-member of a membership organization to a member of the membership organization.
Figure 4A:
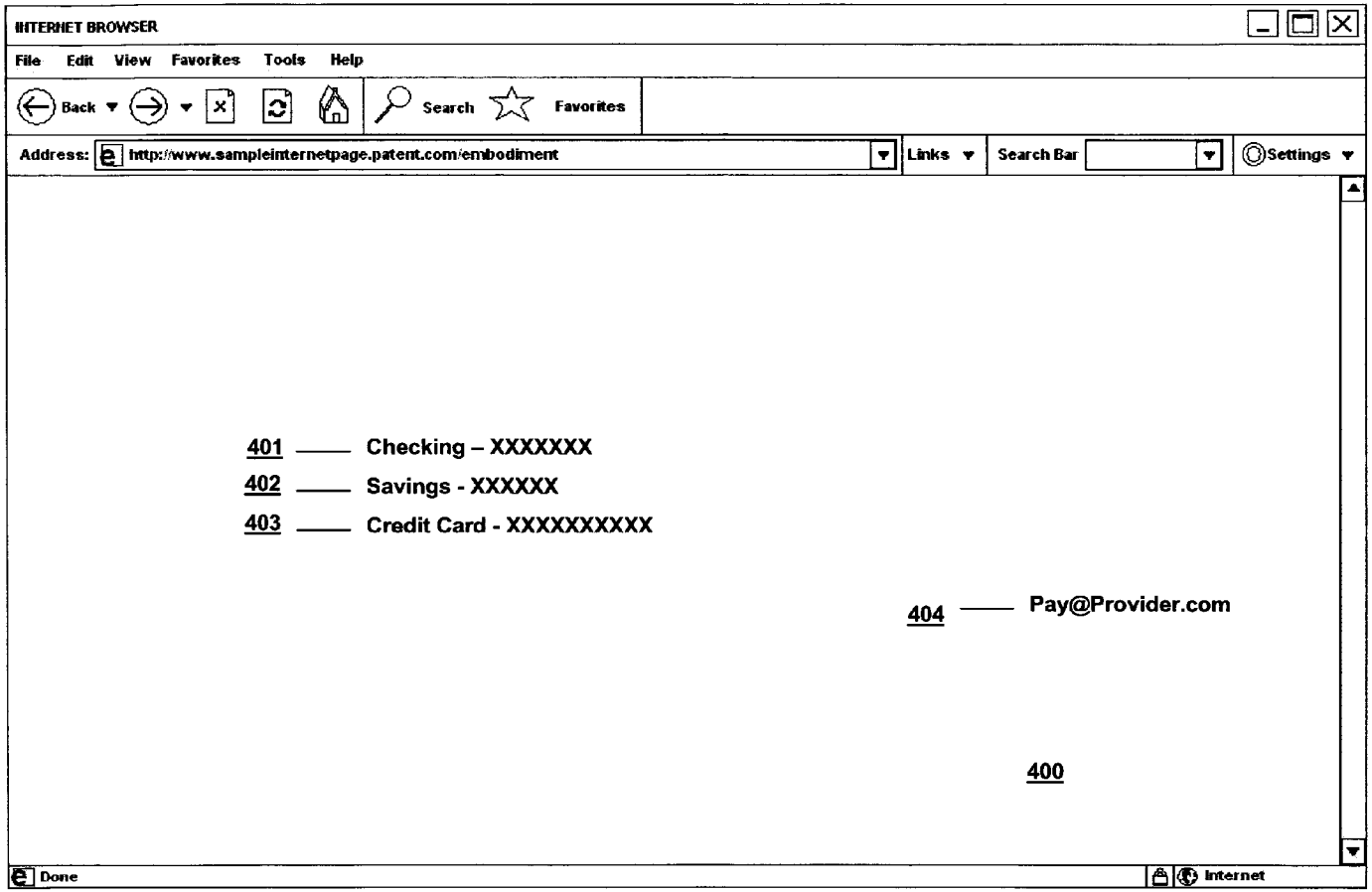
FIG. 4*a* is a screenshot illustrating an embodiment of a Member Account webpage used to provide a payment.
Figure 4B:
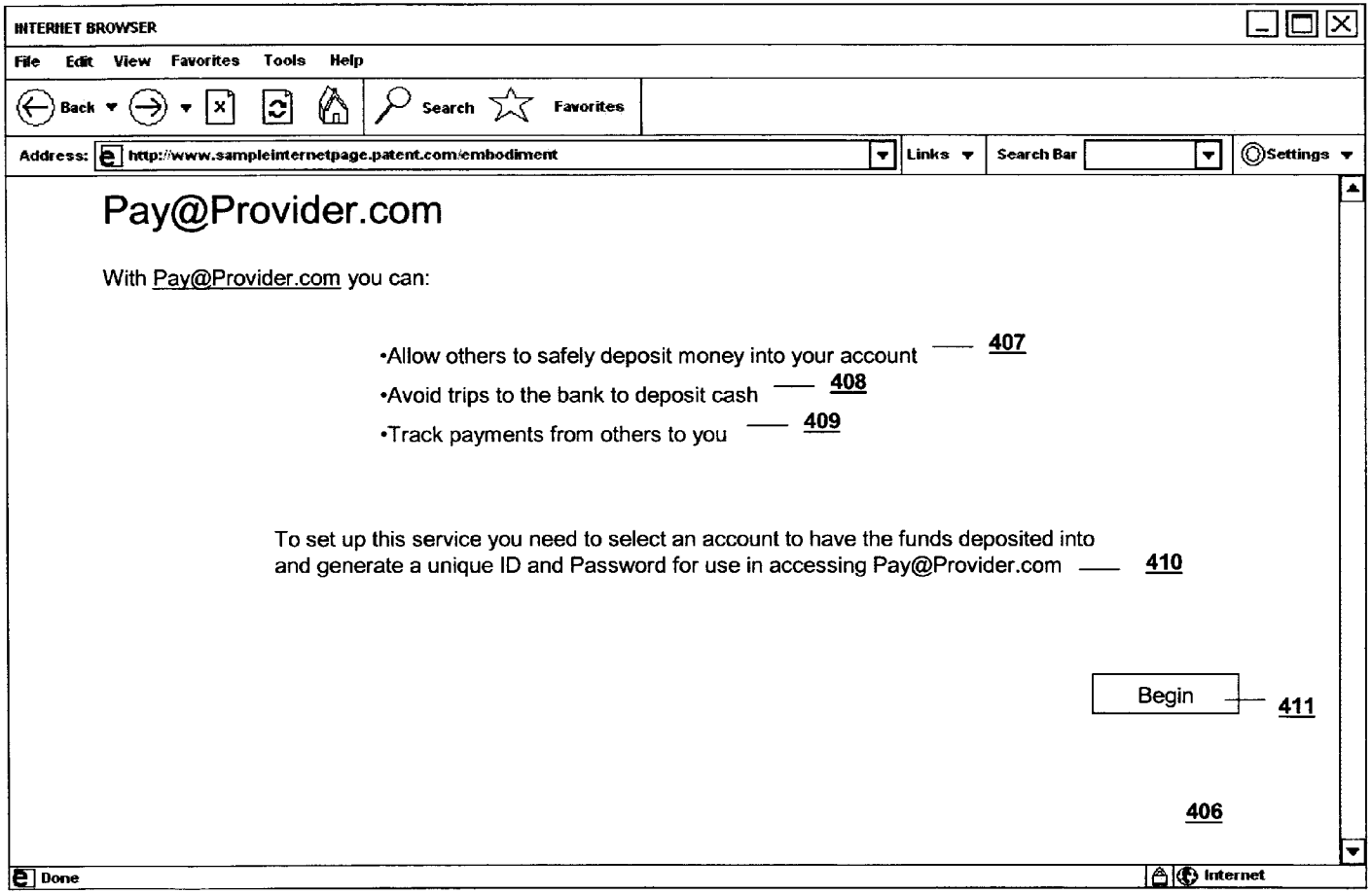
FIG. 4*b* is a screenshot illustrating an embodiment of a Member Explanation webpage used to provide a payment.
Figure 4C:
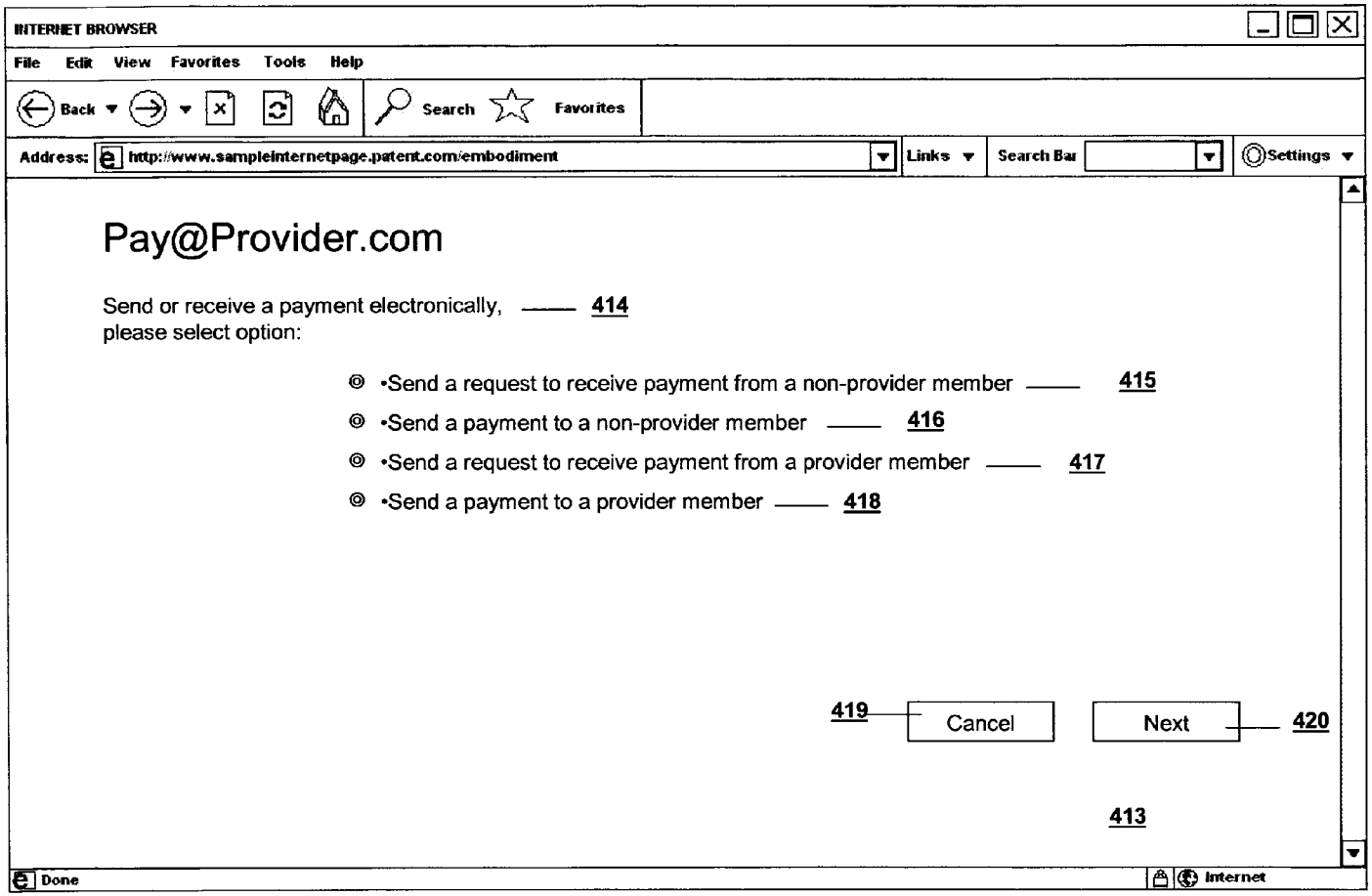
FIG. 4*c* is a screenshot illustrating an embodiment of a Transfer Type Selection webpage used to provide a payment.
Figure 4D:
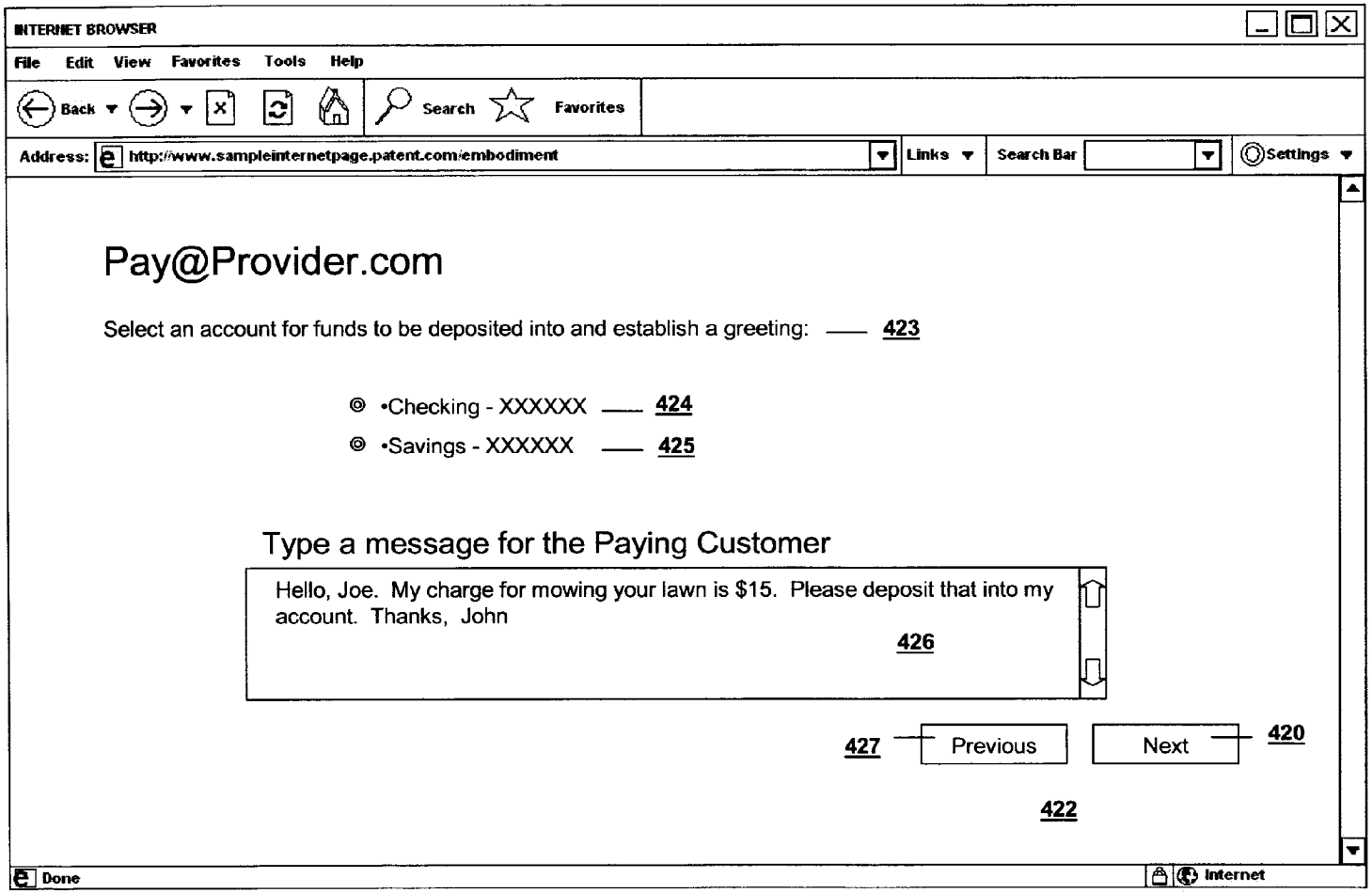
FIG. 4*d* is a screenshot illustrating an embodiment of a Member Account Selection webpage used to provide a payment.
Figure 4E:
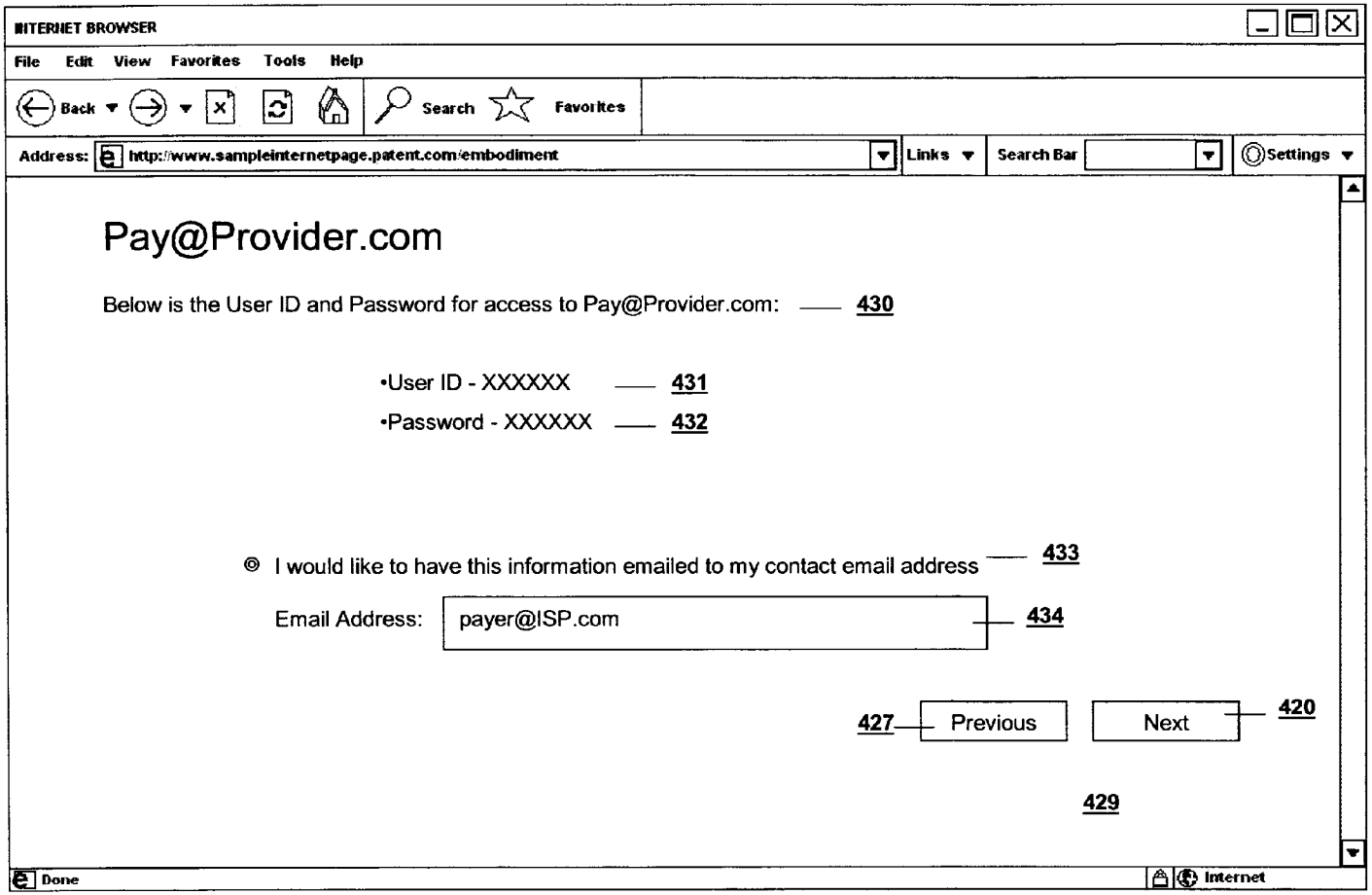
FIG. 4*e* is a screenshot illustrating an embodiment of a Member ID and Password webpage used to provide a payment.
Figure 4F:
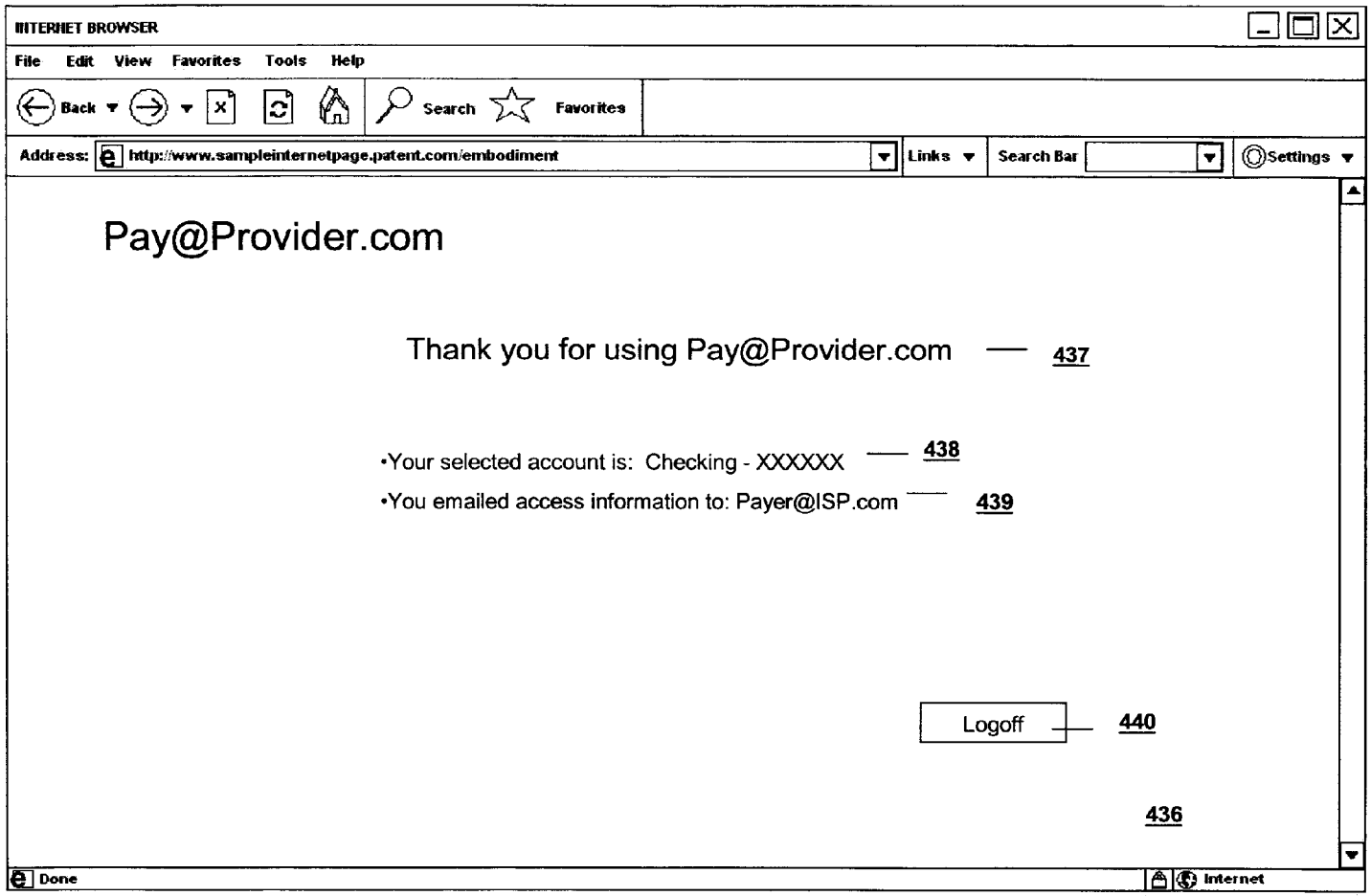
FIG. 4*f* is a screenshot illustrating an embodiment of a Member Confirmation webpage used to provide a payment.
Figure 4G:
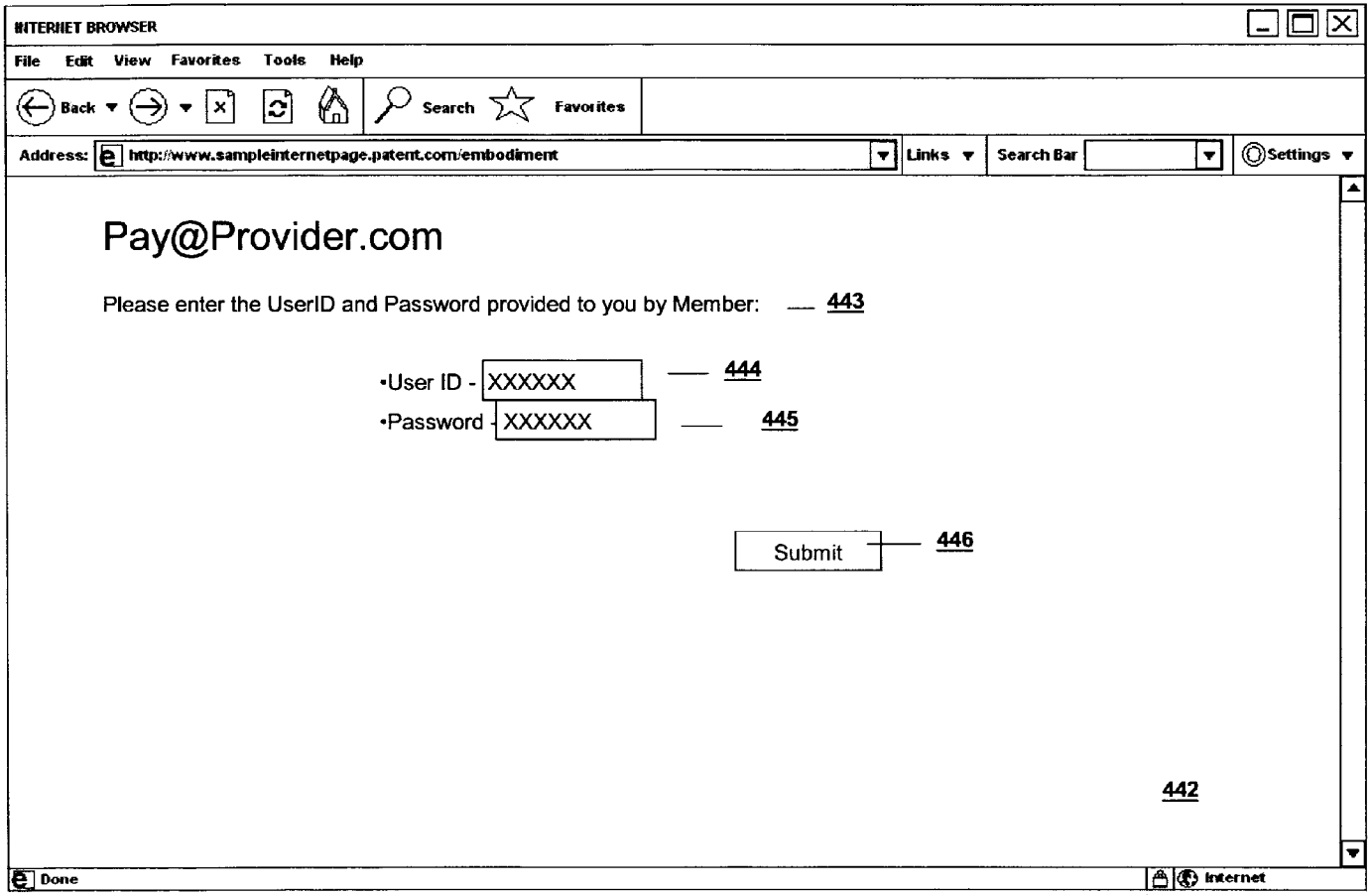
FIG. 4*g* is a screenshot illustrating an embodiment of a Payer Main Entry webpage used to provide a payment.
Figure 4H:
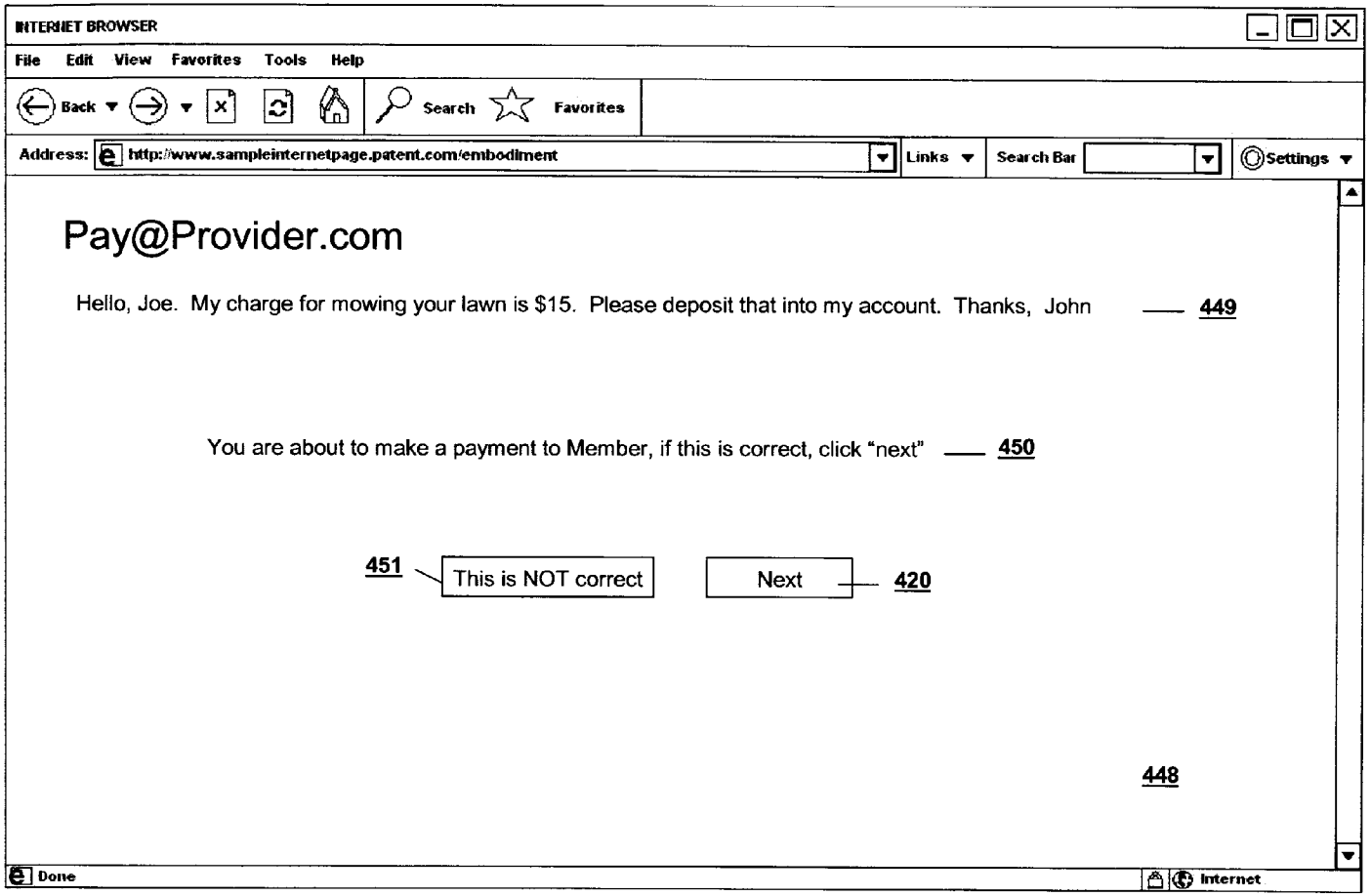
FIG. 4*h* is a screenshot illustrating an embodiment of a Payer Confirmation webpage used to provide a payment.
Figure 4I:
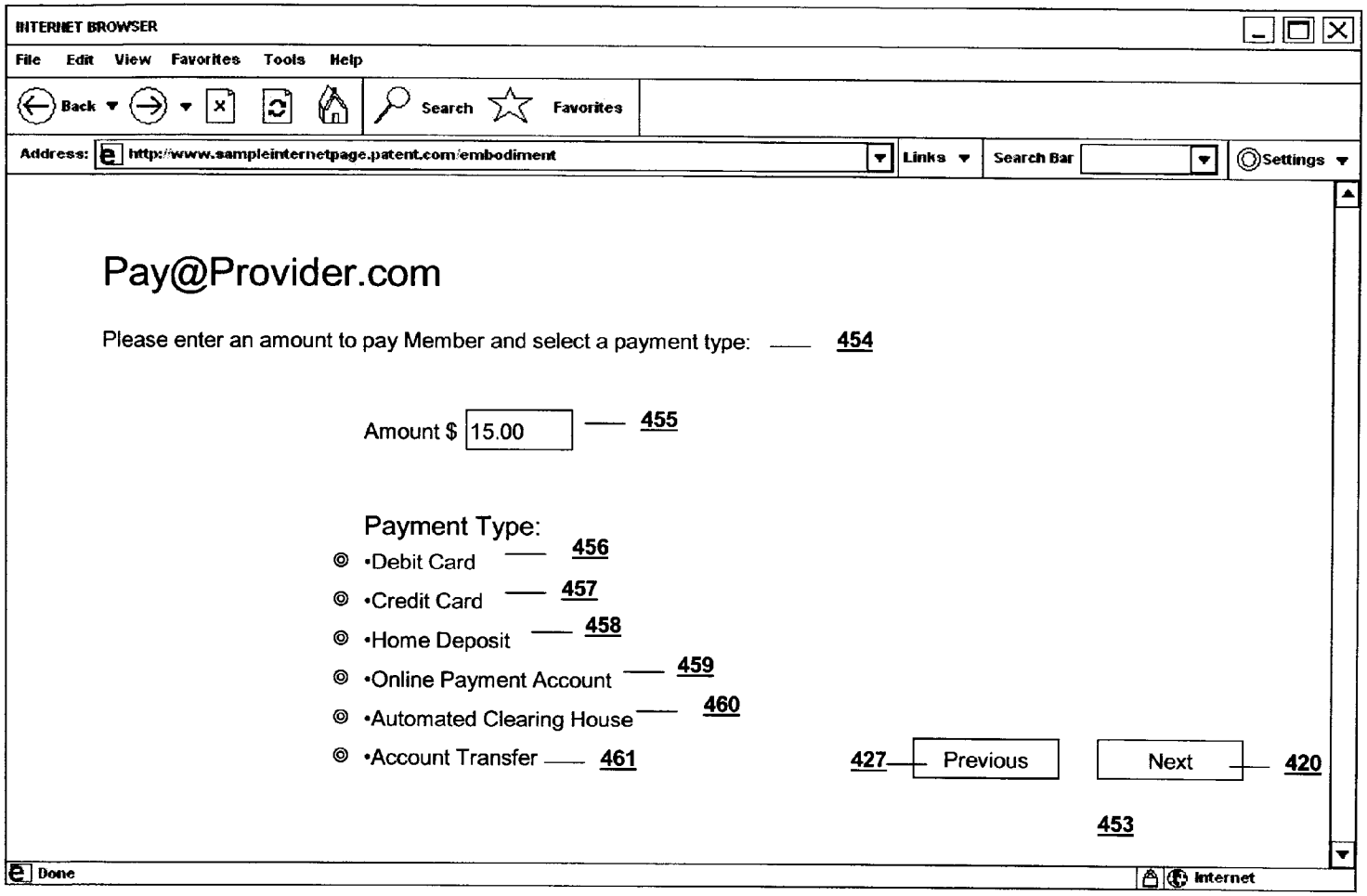
FIG. 4*i* is a screenshot illustrating an embodiment of a Payment Selection webpage used to provide a payment.
Figure 4J:
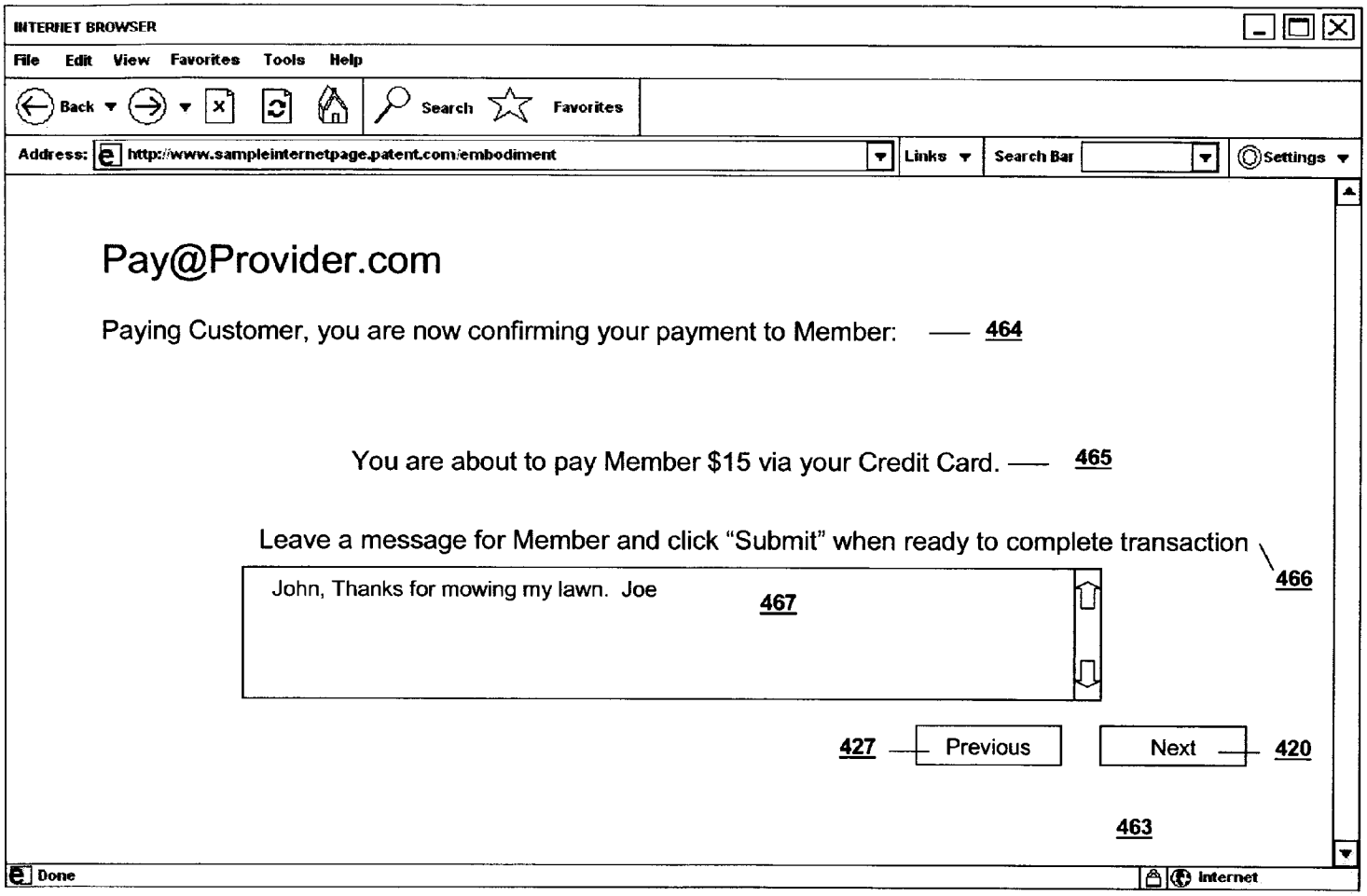
FIG. 4*j* is a screenshot illustrating an embodiment of a Payment Confirmation and Message webpage used to provide a payment.
Figure 4K:
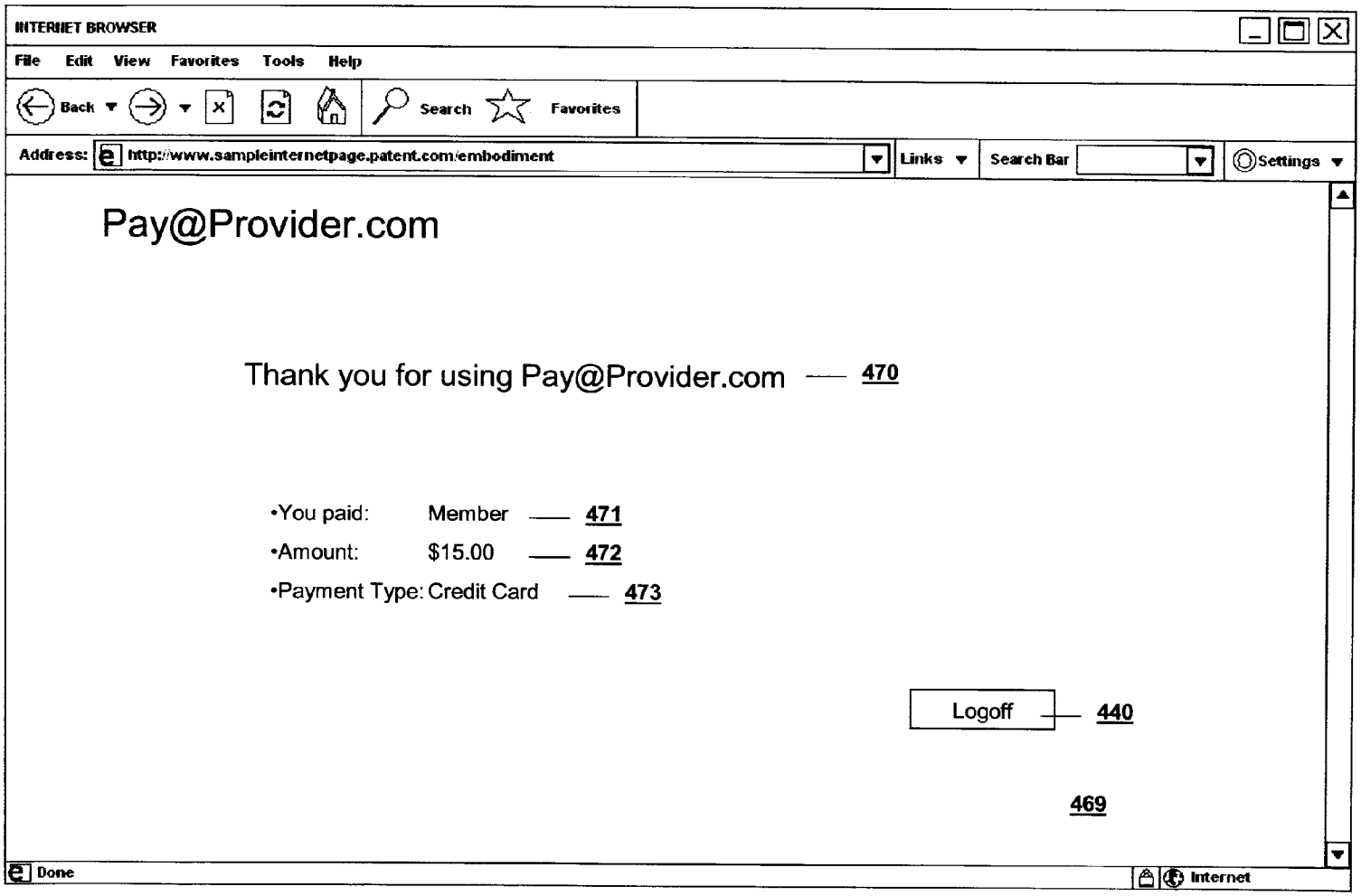
FIG. 4*k* is a screenshot illustrating an embodiment of a Result and Receipt webpage used to provide a payment.
Figure 4I:
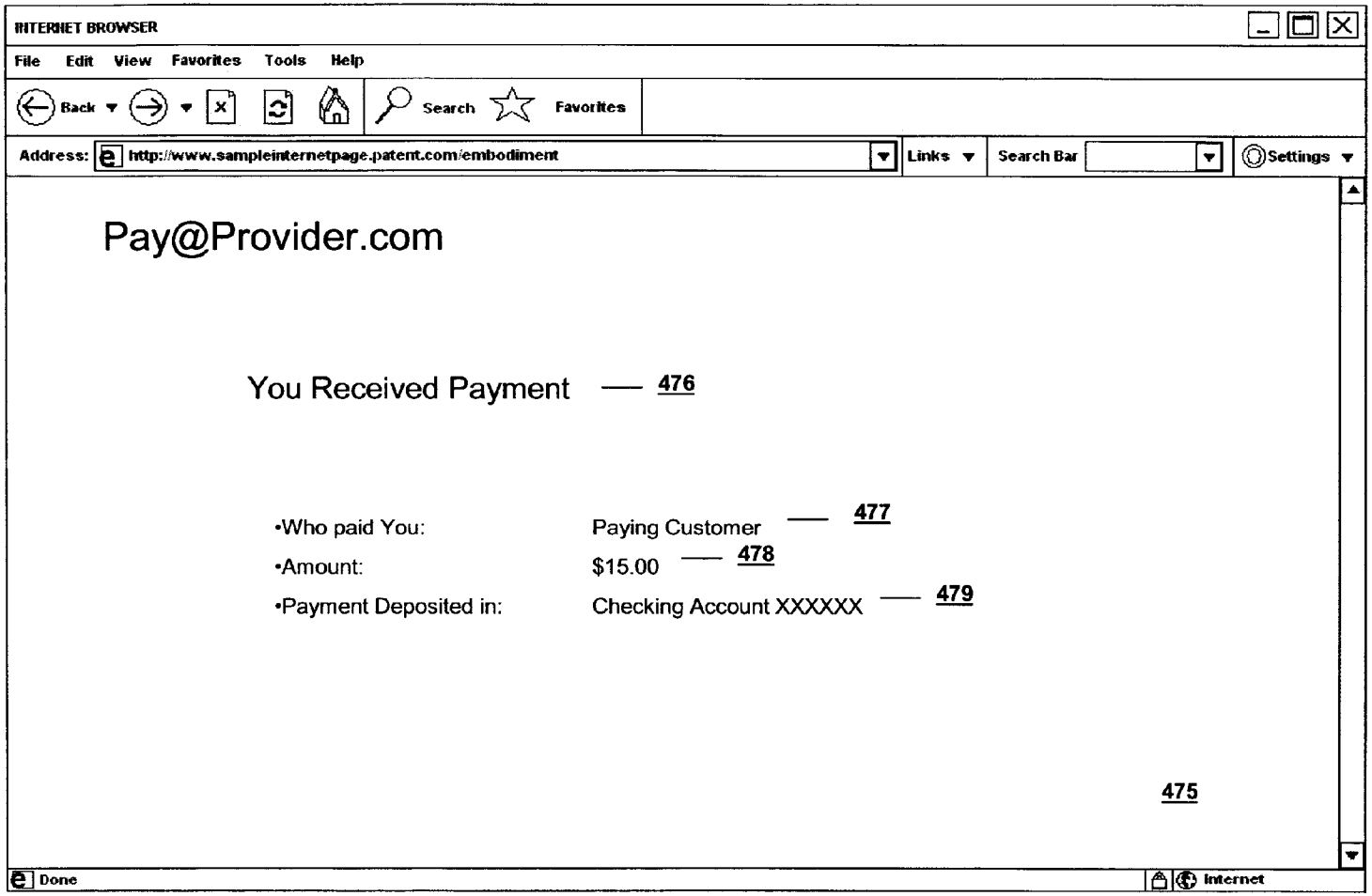

Referring now to FIGS. 1*a*, 1*b* and 1*c*, the provider 104 is illustrated in more detail. A member communication engine 124 which may be, for example, software stored on the computer-readable medium 122 in the IHS 112, is included in the provider 104 and is operably coupled to a member information database 126 and to the network 102. A non-member engine 128 which may be, for example, software stored on the computer-readable medium 122 in the IHS 112, is included in the provider 104 and is operably coupled to the member communication engine 124, to a non-member information database 130, and to the network 102. In an embodiment, the member information database 126 and the non-member information database 130 are conventional databases known in the art. In an embodiment, the member information database 126 and the non-member information database 130 may be located outside the provider 104 and may still be operably coupled to the provider 104 and the engines 124 and 128 through, for example, the network 102.

In an embodiment, the member information database 126 and the non-member information database 130 each include a plurality of databases. In an embodiment, the provider 104 is a membership organization and the member information database 126 includes a variety of previously collected information about members of the membership organization. In an embodiment, the provider 104 is a membership organization and the non-member information database 130 includes a variety of previously collected information about non-member entities interacting with the provider 104 (such as, for example, where the provider 104 has previously facilitated payments between members 106, 108, and/or 110 and non-members 109 and 111). In an embodiment, the member information database 126 and the non-member information database 130 are publicly-available databases. In an embodiment, the member information database 126 and the non-member information database 130 are private database which are available to be accessed by the provider 104.

Referring now to FIGS. 1*a*, 1*b*, 1*c* and 2*a*, a system 200 to request a payment is illustrated. The system 200 allows a payee 202 to create a request for a payment and send the request for the payment to a payer 204. In an embodiment, the payee 202 is the member 106 and the payer 204 is the member 108. In an embodiment, the payee 202 is the member 106 and the payer 204 is the non-member 111. In an embodiment, the payee 202 is the non-member 109 and the payer 204 is the member 108. In an embodiment, the payee 202 is the non-member 109 and the payer 204 is the non-member 111. In an embodiment, the payee 202 may access an Internet webpage pay portal 206 to create a request for payment. Using the pay portal 206, the member communication engine 124, and/or the non-member communication engine 128, the payee 202 generates a user ID and password that will allow the payer 204 to access the pay portal 206 and transfer payment to an account selected by the payee 202. In an embodiment, the pay portal 206 is a secure system provided by the provider 104 and accessible by a member 106, 108, and/or 110 and a non-member 109 and/or 111 through for example, the network 102. The payer 204 may receive access information 208 from the payee 202 or the provider 104. In an embodiment, the access information 208 includes a pay portal Internet address 210, a user ID 212, a password 214, and instructions 216. The pay portal Internet address 210 directs the payer 204 to a secure system provided by the provider 104. Using the secure system, the payer 204 may pay the payee 202 for products or services. The user ID 212 and the password 214 allow the payer 204 access to the secure system. The instructions 216 include instructions for the payer 204 to pay the payee 202 (e.g., an amount, a due date, etc.) and to guide the payer 204 through the process of paying the payee 202.

Referring now to FIGS. 1*a*, 1*b*, 1*c* and 2*a* and 2*b*, a system 201 to make a payment is illustrated. After the payer 204 receives the access information 208 to make the payment, described above with reference to FIG. 2*a*, the payer 204 enters the pay portal Internet address 210 into an internet browser address line to direct the payer's IHS 112 to the pay portal 206. The payer 204 then enters the user ID 212 and the password 214 into corresponding fields on the pay portal 206 to enter the secure site provided by the provider 104 and make the payment to the payee 202. The payer 204 may then make a payment to the payee 202 by transferring the amount of the payment to an account designated by the payee 202. In an embodiment, the account designated by the payee 202 is held by the provider 104. In an embodiment, for security reasons, the payment is transferred to the payee 202's account without allowing the payer 204 to receive any information about the payee 202's account. Once the payment is credited to the payee 202's account, a confirmation/payment notice 218 may be delivered to the payer 204 and the payee 202 informing them that the payment transfer has been completed. In an embodiment, the user ID 212 and password 214 expire after the payment has been completed and cannot be used again by the payer 204 to gain access to the secure system provided by the provider 104 through the pay portal.

Referring now to FIGS. 1*a*, 1*b*, 1*c*, 2*a*, 2*b*, 3*a*, 3*b*, and 3*c*, three alternative embodiments of methods 300, 302, and 304 to provide a payment are illustrated. The method 300 illustrates an embodiment of a payment from a member of a membership organization to another member of the membership organization. The method 302 illustrates an embodiment of a payment from a member of a membership organization to a non-member of the membership organization. The method 304 illustrates an embodiment of a payment from a non-member of a membership organization to a member of the membership organization. The methods 300, 302, and 304 include various tasks to be completed during the payment transaction. The tasks may be completed using the member communication engine 124 and/or the non-member communication engine 128. The member communication engine 124 and the non-member communication engine 128 may store and retrieve information from the member information database 126 and the non-member information database 130, respectively.

As will be described in further detail below, the authorization tasks 310*a*, 310*b*, and/or 310*c* allow the payor 204 to access the pay portal 206 to complete the payment requested by the payee 202. The preference tasks 311*a*, 311*b*, and/or 311*c* allow a member 106, 108, and/or 110 to setup payment transaction preferences such as, for example email addresses, account information, and etc., on the pay portal 206. The setup tasks 312*a*, 312*b*, and/or 312*c* allow a payer 204 to setup and initiate the payment (e.g. the transfer of money from payer 204 to payee 202). The transfer tasks 313*a*, 313*b*, and/or 313*c* allow the provider 104 to determine a location to transfer the payment. The completion tasks 314*a*, 314*b*, and/or 314*c* allow the provider 104 to transfer the payment, therein completing the online payment. The location tasks 315*b* and/or 315*c* allow the provider 104 to communicate with a fund holder, other than the provider 104, for extracting the payment or depositing the payment. Thus, if the fund holder (e.g., a financial institution, a credit institution, or a variety of other fund holder entities) is the payer's 204 account holder, the provider 104 may receive the payment from the fund holder and deposit the payment into an account designated by the payee 202. In the alternative, if the fund holder is the payee's 202 account holder, the provider 104 may transfer payment to the account held by the fund holder and designated by the payee 202.

Referring now to FIGS. 1*a*, 1*b*, 1*c*, 2*a*, 2*b*, and 3*a*, a method 300 to provide a payment from a member of a membership organization to another member of the membership organization is illustrated. In the illustrated embodiment, the payer is the member 106 and the payee is the member 108. The method 300 begins at block 320 in the authorization task 310*a* where the member 106 logs in to the pay portal 206 using the Pay Portal Internet Address 210, the user ID 212, and the password 214 provided by the member 108. In an embodiment, after the member 106 successfully logs in to the pay portal 206 at block 320, the member 106 may optionally provide settings for the preferences task 311*a*. To set-up the preferences task 311*a*, the member 106 may enter information onto a series of Internet webpages provided by the member communication engine 124. The information entered may be stored in the member information database 126. For example, the method 300 may then proceed to block 321 where the member 106 selects a My Profile and Preferences link on the pay portal 206. After the My Profile and Preferences link is selected, the method 300 then proceeds to block 322 where the member 106 is provided a Personal Information webpage. The method 300 then proceeds to block 323 where the member 106 may enter a primary email address to use for receiving communications from the provider 104. Communications from the provider 104 to the member 106 may be generated using the member communication engine 124 and sent to the member 106 via the network 102. The method 300 then proceeds to block 324 where the member 106 may enter a secondary email address to use for receiving communications from the provider 104. If the primary email address entered in block 323 fails, the provider 104 may send communications to the member 106 at the secondary email address provided in block 324. The method 300 then proceeds to block 325 where the member 106 may provide a default withdrawal account to withdrawal payment from in order to pay the member 108. The account options for withdrawal may include a checking account, a savings account, a credit card account, a debit card account, or a variety of other financial accounts. In an embodiment, the provider 104 will transfer the payment to the member 108 from the default account. The method 300 then proceeds to block 326 where the member 106 may select a default deposit account in which the provider 104 is to deposit funds, if the member 106 receives a payment. The default deposit account may be a checking account, a savings account, a credit account, or a variety of other types of account. The method 300 then proceeds to block 327 where the member 106 may select whether or not to receive an email notification to the primary and/or secondary email addresses when a payment is transferred to the member's 106 account. The method 300 then proceeds to block 328 where the member 106 may select whether or not to receive an email notification to the primary and/or secondary email addresses when a payment is transferred from the member's 106 account.

After the member 106 completes the preferences task 311*a*, or if the member 106 does not provide settings for the preferences task 311*a*, the method 300 proceeds to the setup task 312*a* for the member 106 to initiate a payment to the member 108. In an embodiment, to initiate the setup task 312*a*, the member 106 enters information onto a series of Internet webpages provided by the member communication engine 124. The information entered may be stored in the member information database 126. The method 300 then proceeds to block 330 where the member 106 selects a Banking link on the pay portal 206 to go to a banking portion of the secured system provided by the provider 104. The method 300 then proceeds to block 331 where the member 106 selects a Transfer Funds link on the pay portal 206. The method 300 then proceeds to block 332 where the member 106 selects a Make a Third Party Transfer link on the pay portal 206. The method 300 then proceeds to block 333 where the member 106 enters the email address for the payee (e.g., the member 108). By having the member 106 enter only the email address of the member 108 to identify the member 108 as the payee 202, the member 106 does not need to know personal information such as, for example account numbers, social security numbers, and/or a variety of other private information about the payee 202, thus creating a safer money transfer system. The method 300 then proceeds to block 334 where the member 106 may choose an account from which to transfer the payment. In an embodiment, if the member 106 only has one account held by the provider 104, or the default withdrawal account is set in block 325 of the method 300, block 334 may be skipped. The method 300 then proceeds to block 335 where the member 106 enters an amount of payment to withdrawal from the selected account and transfer to the member 108. After entering an amount in block 335, the method 300 then proceeds to block 336 where the member 106 selects a next button on the pay portal 206. The method 300 then proceeds to block 337 where the member 106 is given the opportunity to review the details of the payment such as, for example, the email address of the payee, the withdrawal account, the amount, and/or a variety of other information about the payment. The member 106 may be required to select a confirm button on the pay portal 206 to complete the payment. The method 300 then proceeds to block 338 where a confirmation message confirming the payment is displayed on the pay portal 206. If the member 106 enabled the transfer notification in block 327, the method 300 may then proceed to block 339 and provide a confirmation email message to the member 106 confirming the payment.

After completing the setup task 312*a*, the method 300 proceeds to the transfer task 313*a*. In an embodiment, the transfer task 313*a* is performed by the provider 104. In the illustrated embodiment, the payment is from member 106 to member 108 (e.g., both members of provider's 104 membership organization), and the member 108 may also have provided settings in the preferences task 311*a*. Thus, the member 108 may have entered a contact email addresses (e.g., in block 323), default withdrawal and deposit accounts, and notification selections, substantially similarly as described above for member 106.

In block 333, the member 106 entered the payee's email address (e.g., member 108's email address) so the provider 104 may properly identify where to transfer the payment. In an embodiment, the provider 104 stores email addresses in the member information database 126 and the non-member information database 130 depending on whether the email address belongs to a member or a non-member of the membership organization. Along with the email addresses, the provider 104 may store other information relating to the owner of the email address such as, for example, a name, an address, a telephone number, a social security number, financial account numbers, preferences, and/or a variety of other information relating to the owner of the email address. Therefore, when the member 106 wants to send payment to the member 108, the member communication engine 124 and/or the non-member communication engine 128 search the databases 126 and 130 for stored deposit account information for the owner of the email address entered in block 333. If deposit account information for the email address is found, the method 300 then proceeds to block 351 where the method 300 acknowledges that the deposit account is known by the provider 104. If the deposit account information for the email address is not found, the method 300 then proceeds to block 352 where the transfer task 313*a* requests information about where to transfer the payment. Because, in this example, the provider 104 does not know where to transfer the payment, (e.g., the member 108 has not set default deposit account information in block 326), the method 300 proceeds then to block 353 where the payment funds are transferred to a holding account, known as a lockbox, for safe keeping until a transfer location can be identified. Method 300 then proceeds to block 354 where the provider 104 sends an email message to the email address of the member 108 requesting information about a deposit account for transferring the payment and/or requesting that the member 108 enter default deposit information in block 325 of the preferences task 311*a*. After the member 108 supplies deposit account information to the provider 104, the method 300 then proceeds to block 351. Once again, the method 300 acknowledges that the deposit account is known by the provider 104 and the method 300 then proceeds from the transfer task 313*a* to the completion task 314*a*.

The completion task 314*a* allows the provider 104 to transfer the payment to an account selected by the member 108. In an embodiment, method 300 then proceeds to block 355 within the completion task 314*a* to transfer the payment to the account selected by the member 108 to complete the online transfer of the payment. The method 300 then proceeds to block 356 where the provider 104 sends a confirmation email message to member 108 that the payment has been deposited into an account selected by the member 108 and the method 300 ends.

Referring now to FIGS. 1*a*, 1*b*, 1*c*, 2*a*, 2*b*, 3*a*, and 3*b*, a method 302 to provide a payment from a member of a membership organization to a non-member of the membership organization is illustrated. In the illustrated embodiment, the payer is the member 106 and the payee is the non-member 109. The method 302 begins at block 320 in the authorization task 310*b* where the member 106 logs in to the pay portal 206 using the Pay Portal Internet Address 210, the user ID 212, and the password 214 provided by the non-member 109. In an embodiment, after the member 106 successfully logs in to the pay portal 206 at block 320, the member 106 may optionally provide settings for the preferences task 311*b*. To set-up the preferences task 311*b*, the member 106 may enter information onto a series of Internet webpages provided by the member communication engine 124 substantially similarly to that described above with reference to preferences task 311*a* in method 300.

After the member 106 completes the preferences task 311*b*, or if the member 106 does not provide settings for the preferences task 311*b*, the method 302 proceeds to the setup task 312*b* for the member 106 to initiate a payment to the non-member 109. In an embodiment, to initiate the setup task 312*b*, the member 106 enters information onto a series of Internet webpages provided by the member communication engine 124 substantially similarly to that described above with reference to the setup task 312*a* in method 300. However, in setup task 312*b*, the payee's 204 email address entered in block 333 may be the email address of non-member 109.

After completing the setup task 312*b*, the method 302 then proceeds to the transfer task 313*b*. In an embodiment, the transfer task 313*b* is performed by the provider 104 substantially similarly to that described above with reference to transfer task 313*a* for method 300.

In block 333 of the setup task 312*b*, the member 106 enters the payee's email address (e.g., the non-member 109's email address) so the provider 104 may identify where to send the payment. When the member 106 wants to send payment to the non-member 109, the member communication engine 124 and/or the non-member communication engine 128 search the databases 126 and 130 for stored deposit account information relating to the owner of the email address. If deposit account information for the email address is found, the method 300 then proceeds to block 351 where the method 300 acknowledges that the deposit account is known by the provider 104. If the deposit account information for the email address is not found, the method 300 then proceeds to block 352 where the transfer task 313*a* tries to determine information about where to transfer the payment. If the provider 104 does not know where to transfer the payment, the method 300 proceeds to block 353 where the payment funds are transferred to a holding account, known as a "lockbox," for safe keeping until a transfer location can be identified. Method 300 then proceeds to block 354 where the provider 104 sends an email message to the email address entered in block 333 requesting information about a deposit account for depositing the payment.

Because non-member 109 is not a member of the provider's 104 membership organization, the provider 104 may not have any information about the non-member 109 stored on the non-member information database 130. The method 302 then proceeds to the location task 315*b* to determine a location to transfer the payment. Within the location task 315*b*, the method 302 proceeds to block 361 where the non-member 109 is directed to the pay portal 206 to provide a financial account to receive the payment. The method 302 may then proceed to block 362 where the non-member 109 may enter or select a bank account to use as the account for receiving the payment. It is understood that the account selected in the location task 315*b* may be held by a financial institution other than the provider 104. The method 302 then proceeds to block 363 where the non-member 109 enters deposit account information, such as, for example, the account holder for the account, the account number, the routing number, and/or a variety of other information. The provider 104 may then use this account information to route the payment to the selected account. The method 302 then allows the non-member 109 to decide whether to cache the deposit account information with the provider 104 for later use (e.g. future deposits). If the non-member 109 wishes to cache the account information with the provider 104, the method 302 then proceeds to block 364 where the account information is stored on the non-member information database 130 for later retrieval and use. The method 302 then proceeds to block 365 where the non-member 109 may select a password to be associated with account information and which provides access for the member 109 to modify the account information stored on the non-member information database 130 in the future. If the non-member 109 does not wish to cache the account information with the provider 104, the provider 104 will use the account information for the present payment and the method 302 then proceeds to block 366. The method 302 then proceeds from blocks 365 and 366 to block 367 where the non-member is requested to select a next button to verify and confirm the entered information. The method 302 then proceeds to block 368 where the non-member 109 confirms the account information. After the non-member 109 confirms the account information, the method 302 then proceeds to block 369 where the method 302 displays the confirmed information for the non-member to see. The location task 315*b* of method 302 then proceeds to block 370 where the method 302 uses the member communication engine 124 to send an email message to the member 106 that a deposit account has been established and verified and the payment may now be completed. The method 302 may then proceed from block 369 of the location task 315*b* to block 351 of the transfer task 313*b* as the deposit account is now known by the provider 104 and the provider may now complete the online payment.

After the non-member 109 supplies deposit account information to the provider 104, the method 302 then proceeds from block 353 to block 351. The method 302 acknowledges that the deposit account is known by the provider 104 and the method 302 then proceeds from the transfer task 313*b* to the completion task 314*b*. In an embodiment, the completion task 314*b* is performed by the provider 104 to complete the payment and end the method 302 by notifying the non-member 109 substantially similarly to that described above with reference to completion task 314*a* for method 300.

Referring now to FIGS. 1*a*, 1*b*, 1*c*, 2*a*, 2*b*, 3*a*, 3*b*, and 3*c*, a method 304 to provide a payment from a non-member of a membership organization to a member of the membership organization is illustrated. In the illustrated embodiment, the payer is the non-member 109 and the payee is the member 106. The method 304 begins with a setup task 312*c* where the non-member 109 accesses the pay portal 206 at block 342 where the non-member 109 initiates a payment to the member 106. The method 304 then proceeds to block 343 where the non-member 109 enters an email address for the payee, (e.g., member 106). The method 304 then proceeds to block 344 where the non-member enters an email address at which the non-member may be contacted by the provider 104. By entering the email addresses in blocks 343 and 344, the provider may use the email address to identify the member 106 and the non-member 109 using the member communication engine 124 and the non-member communication engine 128. The method 304 then proceeds to block 345 where the non-member 109 enters an amount of payment to be paid to the member 106.

The method 304 then exits the setup task 312*c* and enters the authorization task 310*c* where the non-member 109 provides authorization to make the payment. If the non-member 109 has previously used method 304 to make a payment, the provider 104 may already have a fund source location provided by the non-member 109, saved on the non-member information database 130. If the non-member 109 has not previously used the method 304 to make a payment, the non-member 109 may use the location task 315*c* to provide the provider 104 a source for funds for the payment. The method 304 then proceeds to block 346 where the non-member 109 does not need to provide a security password to authenticate the non-member 109. The method then proceeds to block 347 where the non-member 109 selects a next button on the pay portal 206 to enter the location task 315*c* to enter a source for funds for the payment. However, if the non-member 109 has previously established a source for funds for the payment, the non-member 109 may enter a security password on the pay portal 206 to provide authentication of the non-member 109 at block 348. After a correct password has been provided by the non-member 109, the method 304 proceeds then to block 349 where the non-member 109 selects a next button on the pay portal 206 to enter the location task 315*c* to verify and confirm the online payment at block 380.

The method 304 then proceeds to the location task 315*c* where the non-member 109 provides source information for the payment and verifies the transaction. The location task 315*c* is similar to the location task 315*b* described above with reference to FIG. 3*b* in that the non-member 109 may use the location task 315*c* to enter financial account information for the provider 104 to use in transferring the payment. However, the location task 315*b* is for a fund deposit location, while the location task 315*c* is for a fund source for the payment. Within the location task 315*c*, the method 304 then proceeds to block 371 where the non-member 109 uses the pay portal 206 to select a financial account from which to provide the payment such as, for example, a bank account or a credit/debit card account. In an embodiment, the method 304 proceeds to block 372 if the non-member 109 enters or selects a bank account as the fund source to use as an account for funding the payment. It is understood that the account selected in the location task 315*c* may be held by a financial institution other than the provider 104. The method 304 then proceeds to block 373 where the non-member 109 enters fund source account information, such as, for example, the account holder of the account, the account number, the routing number, and/or a variety of other information. The provider 104 may then use this account information to withdrawal the payment from the provided account. In an embodiment, the method 304 proceeds to block 374 if the non-member 109 enters or selects a credit/debit card account as the fund source to use as an account for funding the payment. It is understood that the account selected in the location task 315*c* may be held by a financial institution other than the provider 104. The method 304 then proceeds to block 375 where the non-member 109 enters fund source account information such as, for example, the account holder for the account, the account number, the security code for the account, and/or a variety of other information. The provider 104 may then use this account information to withdrawal the payment from the provided account. The method 304 then allows the non-member 109 to decide whether to cache the account information with the provider 104 for later use (e.g. future payments). If the non-member 109 wishes to cache the account information with the provider 104, the method 304 then proceeds to block 376 where the account information is stored on the non-member information database 130 for later retrieval and use. The method 304 then proceeds to block 377 where the non-member 109 may select a password to be associated with the account information and which provides access for the non-member 109 to modify the account information stored on the non-member information database 130 in the future. If the non-member 109 does not wish to cache the account information with the provider 104, the provider 104 will only use the account information for the present payment and the method 304 then proceeds to block 378. The method 304 may proceed from either block 377 or 378 to block 379 where the non-member 109 is requested to select a next button on the pay portal 206 to verify and confirm the entered information. The method 304 then proceeds to block 380 where the non-member 109 confirms the provided account information. After the non-member 109 confirms the account information, the method 304 then proceeds to block 381 where the method 304 displays the confirmed information for the non-member 109. The method 304 then proceeds to block 370 where the method 304 uses the non-member communication engine 128 to send an email message to the non-member 109 that a fund source account has been established and verified and the payment may now be completed. The method 304 then proceeds from block 381 of the location task 315*c* to block 382 where the provider 104 ages the funds withdrawn from the provided account to verify that the funds are valid and that the funds are available. Aging funds is commonly known to those having ordinary skill in the art to provide time for financial institutions to ensure funds are available in the account. In an embodiment, the funds may be available to the member 106 immediately after receipt into the designated account. After the funds are aged, the method 304 then proceeds to the transfer task 313*c*. In an embodiment, the transfer task 313*c* is performed by the provider 104 substantially similarly to that described above with reference to transfer task 313*a* for method 300.

After the method 304 acknowledges that the deposit account is known by the provider 104, the method 304 then proceeds from the transfer task 313*c* to the completion task 314*c*. In an embodiment, the completion task 314*c* is performed by the provider 104 to complete the payment and the method 304 ends by notifying the member 106 of confirmation of the payment substantially similarly to that described above with reference to completion task 314*a* for method 300.

Referring now to FIGS. 1*a*, 1*b*, 1*c*, 2*a*, 2*b*, and 4*a*, a Member Account webpage 400 used to initiate a payment is illustrated. In an embodiment, the Member Account webpage 400 is provided by the provider 104 to allow a member 106 access to account information such as, for example, a checking account 401, a savings account 402, and/or a credit card account 403 held by the provider 104. In an embodiment, the member 106 may be required to log-in to a secure system provided by the provider 104 to gain access to the Member Account webpage 400. The Member Account webpage 400 may display information about the accounts 401, 402, and/or 403 provided by the provider 104 such as, for example an account number, an account balance, and/or a variety of other information relating to the account. In an embodiment, the Member Account webpage 400 may also include a Pay Portal Entry link 404. When the member 106 is viewing the Member Account webpage 400, the member 104 may select the Pay Portal Entry link 404 to enter the Pay Portal 206 to request payment from, or make a payment to, another member or a non-member.

Referring now to FIGS. 1*a*, 1*b*, 1*c*, 2*a*, 2*b*, 4*a*, and 4*b*, a Member Explanation webpage 406 is illustrated. In an embodiment, when the member 106 selects the Pay Portal Entry link 404 on the Member Account webpage 400, the secure system provided by the provider 104 displays the Member Explanation webpage 406. In an embodiment, the Member Explanation webpage 406 displays a number of features 407, 408, and 409 highlighting benefits of using the pay system. In an embodiment, the Member Explanation webpage 406 may display explanation instructions 410 to help the member 106 set up preferences for making a payment. In an embodiment, the member 106 may select a Begin button 411 to begin the payment process.

Referring now to FIGS. 1*a*, 1*b*, 1*c*, 2*a*, 2*b* and 4*c*, a Transfer Type Selection webpage 413 used to provide a payment is illustrated. In an embodiment, the Transfer Type Selection webpage 413 allows the member 106 to select what type of online payment is to be conducted. Instructions 414 may be included to help explain what the member 106 needs to do for the payment. In an embodiment, the member 106 may select an option to send a request to receive a payment from a non-member 415, to send a payment to a non-member 416, to send a request to receive a payment from a member 417, and to send a payment to a member 418. After making a selection, the member 106 may proceed with the payment process by selecting a Next button 420. However, the member 106 may cancel the payment process by selecting a Cancel button 419.

Referring now to FIGS. 1*a*, 1*b*, 1*c*, 2*a*, 2*b*, and 4*d*, a Member Account Selection webpage 422 used to provide a payment is illustrated. The Member Account Selection webpage 422 includes instructions 423 to inform the member 106 to select a deposit account (e.g., a checking account option 424, a savings account option 425, and/or a variety of other account options) for depositing payments. When the member 106 generates a request for payment, the member 106 may enter a message to the payer 204 in a Message field 426. By entering a message in the message field 426, the member 106 may remind the payer 204 what services or goods for which the payment is being requested. After a deposit account option 424 or 425 has been selected and any message has been entered into the Message field 426, the member 106 may select the Next button 420 to progress to the next page. However, the member 106 may select a Previous button 427 to return to the previous page.

Referring now to FIGS. 1*a*, 1*b*, 1*c*, 2*a*, 2*b* and 4*e*, a Member ID and Password webpage 429 used to provide a payment is illustrated. The Member ID and Password webpage 429 provides instructions 430 to the member 106 that an ID and password are being provided. In an embodiment, the pay portal 206 auto generates a user ID 431 and a password 432 for the payer 204 to use to gain access to the pay portal 206. In an embodiment, the payer 204 may enter the user ID 431 and the password 432 into appropriate fields on a publicly available webpage and after verification of the user ID 431 and the password 432 by the non-member communication engine 128, the payer 204 may be allowed access to a secure system provided by the provider 104 to complete the payment as described above with respect to FIG. 3*c*. The member 106 may select the Email Notification Select button 433 to have an email notification about the online payment sent to the member's 106 email address. In order for the request for payment to be directed to the correct payer 204, the member 106 may enter an email address for the payer 204 into the Email Address field 434, as described above with reference to FIG. 3*c*. The member 106 may select the Previous button 427 to go back to the previous page or the Member Account Select webpage 422. The member 106 may select the Next button 420 to proceed with the payment process.

Referring now to FIGS. 1*a*, 1*b*, 1*c*, 2*a*, 2*b*, and 4*f*, a Member Confirmation webpage 436 is illustrated. The Member Confirmation webpage 436 provides confirmation to the member 106 that the request for payment has been completed. In an embodiment, the Member Confirmation webpage 436 includes a thank you message 437, a selected deposit account message 438 displaying the deposit account in which the payment was deposited, and a payer email address message 439 displaying the email address of the payer 204. At this point in the payment process, the member 106 has now completed sending a request for payment to a payer 204 and may logoff the secured system by selecting the Logoff button 440.

Referring now to FIGS. 1*a*, 1*b*, 1*c*, 2*a*, 2*b*, and 4*g*, a Payer Main Entry webpage 442 used to provide a payment is illustrated. In an embodiment, The Payer Main Entry webpage 442 is a publicly accessible Internet webpage where the payer 202 may follow the instructions 443 provided, may enter a user ID in the User ID field 444, and may enter a password in the Password field 445 to gain access to a the secured system discussed above with reference to FIG. 4*e*. After entering a user Id and password, the payer 204 may select the Submit button 446 to submit the user ID and the password to the communication engines 124 or 128 to validate the identity of the payer 204 by commonly understood methods, and allow access to a secured system provided by the provider 104 for completing the payment.

Referring now to FIGS. 1*a*, 1*b*, 1*c*, 2*a*, 2*b*, and 4*h*, a Payer Confirmation webpage 448 used to provide a payment is illustrated. In an embodiment, after the payer 204 is allowed access to the secure system, the Payer Confirmation webpage 448 supplies to the payer 204 a message 449 that was entered by the member 106 (e.g., the payee 202) in the Message field 426. Instructions 450 inform the payer 204 that the payer 204 is about to make a payment and asks the payer 204 to verify that the payment is to be made to the payee 202, (e.g., the member 106). If information in the instructions 450 is not correct, the payer 204 may select the Not Correct button 451 and the provider 104 will not complete payment from payer 204 to payee 202. However, if the information in the instructions 450 is correct and the payer 204 is ready to make a payment, the payer 204 may select the Next button 420 to proceed with the payment process.

Referring now to FIGS. 1*a*, 1*b*, 1*c*, 2*a*, 2*b*, and 4*i*, a Payment Selection webpage 453 used to provide a payment is illustrated. The Payment Selection webpage 453 allows the payer 204 to enter an amount to pay and a source for the payment similar to that described above with respect to FIGS. 3*a*-3*c*. In an embodiment, the Payment Selection webpage 453 includes instructions 454 to inform the payer 204 what to do on the Payment Selection webpage 453. The payer 204 may enter an amount of payment that the payer 204 wishes to pay to the payee 202 in the Payment Amount field 455, and the provider 104 will transfer that amount from an account of the payer 204 to an account of the payee 202. In an embodiment, the payer 204 may adjust the amount of payment in the Payment Amount field 455. Next, the payer 204 may select a payment type for the payment. For example, in an embodiment, the payer 204 may select the Debit Card button 456, the Credit Card button 457, the Home Deposit button 458, the Online Payment Account button 459, the Automated Clearing House button 460, or the Account Transfer button 461. Payment from the selected account may be made electronically from the selected account. The payer 204 may return to the previous page, the Payer Confirmation webpage 448, by selecting the Previous button 427 or, after entering a payment amount and selecting a payment type, the payer 204 may proceed with the payment process by selecting the Next button 420.

Referring now to FIGS. 1*a*, 1*b*, 1*c*, 2*a*, 2*b*, and 4*j*, a Payment Confirmation and Message webpage 453 used to provide a payment is illustrated. In an embodiment, the Payment Confirmation and Message webpage 453 provides one or messages 464 and 465 to the payer 204 about the payment. The Payment Confirmation and Message webpage 453 provides instructions 466 to the payer 204 about leaving a message to the payee 202 in the Message field 467. The payee 202 may provide a message in the Message field 467 and the provider 104 will provide the message to the payee 202. The payer 204 may return to the previous page, the Payment Selection webpage 453 by selecting the Previous button 427, or the payer 204 may proceed with the payment process by selecting the Next button 420.

Referring now to FIGS. 1*a*, 1*b*, 1*c*, 2*a*, 2*b*, and 4*k*, a Result and Receipt webpage 469 used to provide a payment is illustrated. The Result and Receipt webpage 469 provides record of the online payment to the payer 204 that may be printed as a receipt. In an embodiment, the Result and Receipt webpage 469 may include a message 470 to the payer 204 and information about the payment. For example, an embodiment of the Result and Receipt webpage 469 includes a Who Paid message 471 displaying whom the payer 204 paid, an Amount Paid message 472 displaying the amount of payment that was made, and a Payment Type message 473 displaying the account type used for the payment. The payer 404 may exit the pay portal 206 by selecting the Logoff button 440.

Referring now to FIGS. 1*a*, 1*b*, 1*c*, 2*a*, 2*b* and 4*l*, a Payment Received Message webpage 475 used to provide a message to a payee 202 about a payment is illustrated. In an embodiment, the Payment Received Message webpage 475 may be sent in an email confirmation message to the payee 202. In an embodiment, if the payee 202 is a member (e.g., member 106) of the provider's 104 membership organization, the Payment Received Message webpage 475 may automatically pop-up on a webpage after the member 106 logs in to the secure system provided by the provider 104. In an embodiment, the Payment Received Message webpage 475 may include a Received Payment message 476 displaying that the payee 202 received a payment, a Who Paid you message 477 displaying who payment was received from, an Amount Paid message 478 displaying the amount of payment, and/or a Deposit Account message 479 displaying what account the payment was deposited into.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A computer system to receive a payment, the computer system comprising at least one subsystem having a computing device with a processor and memory for storing executable instructions that are executable by the processor to:

create a request for payment on behalf of a payee, wherein the request for payment designates a payer from which to obtain the payment and comprises instructions for guiding the payer through paying the payee via a secure payment portal, the payee being a customer of a financial services provider and the payer being a non-customer of the financial services provider;

associate the request for payment with an account provided by the financial services provider, the account being selected by and associated with the payee;

send the request for payment to the payer, wherein the payment is adjustable by the payer via the secure payment portal;

provide the payer with user identification and a user password that are created by the payee, the user password being authorized for use in only a first utilization by the payer to access the secure payment portal through which the payer can direct payment to the account according to the instructions and without identifying the account to the payer;

receive the payment from the payer in the account provided by the financial services provider via the secure payment portal, according to the instructions, and via the first utilization of the user identification and the user password by the payer; and prohibit the user identification and the user password from a second utilization.

2. The computer system of claim 1, wherein the request for payment is for at least one of:

goods and services rendered to the payer.

3. The computer system of claim 1, wherein the payment from the payer is by at least one of:

credit account, debit account, and fund transfer.

4. The computer system of claim 1, wherein upon receiving the payment, funds associated with the payment are immediately available for withdrawal from the account.

5. The computer system of claim 1, wherein sending the request for payment comprises sending an electronic message.

6. The computer system of claim 1, wherein the payer adjusts an amount of the payment.

7. The computer system of claim 1, wherein the financial services provider comprises a membership organization.

8. A computer-readable medium having computer executable code tangibly embodied thereon to receive a payment, said computer executable code, when executed, causes a computer processor to:

create a request for payment on behalf of a payee, wherein the request for payment designates a payer from which to obtain the payment and comprises instructions for guiding the payer through paying the payee via a secure payment portal, the payee being a customer of a financial services provider and the payer being a non-customer of a financial services provider;

associate the request for payment with an account provided by the financial services provider, the account being selected by and associated with the payee;

send the request for payment to the payer, wherein the payment is adjustable by the payer via the secure payment portal;

provide the payer with user identification and a user password that are created by the payee, the user password being authorized for use in only a first utilization by the payer to access the secure payment portal through which the payer can direct payment to the account according to the instructions and without identifying the account to the payer;

receive the payment from the payer in the account provided by the financial services provider via the secure payment portal, according to the instructions, and via the first utilization of the user identification and the user password by the payer; and prohibit the user identification and the user password from a second utilization.

9. The computer-readable medium of claim 8, wherein the request for payment is for at least one of:

goods and services rendered to the payer.

10. The computer-readable medium of claim 8, wherein the payment from the payer is by at least one of:

credit account, debit account, and fund transfer.

11. The computer-readable medium of claim 8, wherein upon receiving the payment, funds associated with the payment are immediately available for withdrawal from the account.

12. The computer-readable medium of claim 8, wherein sending the request for payment comprises sending an electronic message.

13. The computer-readable medium of claim 8, wherein the payer adjusts an amount of the payment.

14. The computer-readable medium of claim 8, wherein the financial services provider comprises a membership organization.

15. A method to receive a payment, the method comprising:

creating, by a computing device having a processor and memory for storing executable instructions that are executable by the processor, a request for payment on behalf of a payee, wherein the request for payment designates a payer from which to obtain the payment and comprises instructions for guiding the payer through paying the payee via a secure payment portal, the payee being a customer of a financial services provider and the payer being a non-customer of the financial services provider;

associating, by the computing device, the request for payment with an account provided by the financial services provider, the account being selected by and associated with the payee;

sending, by the computing device, the request for payment to the payer, wherein the payment is adjustable by the payer via the secure payment portal;

providing, by the computing device, the payer with user identification and a user password that are created by the payee, the user password being authorized for use in only a first utilization by the payer to access the secure payment portal through which the payer can direct payment to the account according to the instructions and without identifying the account to the payer;

receiving, by the computing device, the payment from the payer in the account provided by the financial services provider via the secure payment portal, according to the instructions, and via the first utilization of the user identification and the user password by the payer; and prohibiting, by the computing device, the user identification and the user password from a second utilization.

16. The method of claim 15, wherein the request for payment is for at least one of:

goods and services rendered to the payer.

17. The method of claim 15, wherein the payment from the payer is by at least one of:

credit account, debit account, and fund transfer.

18. The method of claim 15, wherein upon receiving the payment, funds associated with the payment are immediately available for withdrawal from the account.

19. The method of claim 15, wherein sending the request for payment comprises sending an electronic message.

20. The method of claim 15, wherein the payer adjusts an amount of the payment.

21. The method of claim 15, wherein the financial services provider comprises a membership organization.

* * * * *